US012557965B2

(12) United States Patent
Lee et al.

(10) Patent No.: US 12,557,965 B2
(45) Date of Patent: Feb. 24, 2026

(54) TERMINAL DEVICE, DISHWASHER, TERMINAL DEVICE CONTROL METHOD, AND DISHWASHER CONTROL METHOD

(71) Applicant: SAMSUNG ELECTRONICS CO., LTD., Suwon-si (KR)

(72) Inventors: Junho Lee, Suwon-si (KR); Minho Jung, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 478 days.

(21) Appl. No.: 18/072,912

(22) Filed: Dec. 1, 2022

(65) Prior Publication Data

US 2023/0086431 A1 Mar. 23, 2023

Related U.S. Application Data

(63) Continuation of application No. PCT/KR2021/006323, filed on May 21, 2021.

(30) Foreign Application Priority Data

Jun. 12, 2020 (KR) ..... 10-2020-0071775

(51) Int. Cl.
*A47L 15/42* (2006.01)
*A47L 15/00* (2006.01)

(52) U.S. Cl.
CPC ..... *A47L 15/4274* (2013.01); *A47L 15/0018* (2013.01); *A47L 15/4293* (2013.01); *A47L 2301/04* (2013.01)

(58) Field of Classification Search
None
See application file for complete search history.

(56) References Cited

U.S. PATENT DOCUMENTS 6,658,325 B2 12/2003 Zweig
7,110,832 B2 9/2006 Ghent
(Continued)

FOREIGN PATENT DOCUMENTS

EP 1 125 537 B1 8/2003
EP 3 264 386 A1 1/2018
(Continued)

OTHER PUBLICATIONS

International Search Report issued in International Application No. PCT/KR2021/006323 dated Sep. 17, 2021.
(Continued)

*Primary Examiner* — Rita P Adhlakha
(74) *Attorney, Agent, or Firm* — STAAS & HALSEY LLP

(57) ABSTRACT

A dishwasher and a terminal device which creates a washing course to serve a purpose of use based on a user input and provides at least an expected amount of power to be supplied and an expected amount of water to be supplied for the created washing course. The terminal device includes a display for displaying an operating condition of a default washing course of the dishwasher; an input for receiving a command to change the operating condition from a user; and a controller for controlling the display to display at least one of an expected amount of power to be supplied, an expected amount of water to be supplied, and an expected time, which is changed according to a user-set washing course in response to the command received to change the operating condition of the default washing course.

11 Claims, 20 Drawing Sheets

(56) References Cited

U.S. PATENT DOCUMENTS

| | | | | |
|---|---|---|---|---|
| 7,658,806 | B2 | 2/2010 | Jeong et al. | |
| 7,742,951 | B2 | 6/2010 | Ebrom et al. | |
| 8,571,942 | B2 | 10/2013 | Ebrom et al. | |
| 8,627,689 | B2 * | 1/2014 | Finch | F25D 21/04 68/12.12 |
| 8,755,394 | B2 | 6/2014 | Kaluskar et al. | |
| 9,129,127 | B2 | 9/2015 | Hubner et al. | |
| 9,367,984 | B2 | 6/2016 | Daugbjerg et al. | |
| 9,450,811 | B2 | 9/2016 | Dal Bello et al. | |
| 2013/0149509 | A1 | 6/2013 | Federico et al. | |
| 2016/0278567 | A1 | 9/2016 | Gagnon | |
| 2018/0197147 | A1 | 7/2018 | Cigelnik | |
| 2019/0150702 | A1 | 5/2019 | Lukschnat et al. | |

FOREIGN PATENT DOCUMENTS

| | | | |
|---|---|---|---|
| EP | 3 176 983 | B1 | 4/2019 |
| JP | 2006-102005 | A | 4/2006 |
| JP | 2018-57479 | A | 4/2018 |
| KR | 10-2007-0062297 | A | 6/2007 |
| KR | 10-2010-0094953 | A | 8/2010 |
| KR | 10-2014-0032262 | A | 3/2014 |
| KR | 10-2016-0062917 | A | 6/2016 |
| KR | 10-2016-0062918 | A | 6/2016 |

OTHER PUBLICATIONS

International Written Opinion issued in International Application No. PCT/KR2021/006323 dated Sep. 17, 2021.

* cited by examiner

FIG. 10

: VARIABLE OPERATING CONDITION

| | | | Parameter | Time(min) |
|---|---|---|---|---|
| Pre Drain | | | 2800 | 0.5 |
| Pre Wash | Water supply(Litter) | | 3.4 | 1.36 |
| | Circulation Pump | | 2600 | 10 |
| | Target temp | Start | 21 | |
| | | End | 21 | |
| | Drain Pump | | 2800 | 1 |
| Main Wash | Water supply(Litter) | | 2.85 | 1.14 |
| | Circulation Pump | | 2500 | 60 |
| | Target temp | Start | 21 | |
| | | End | 48 | |
| | Drain Pump | | 2800 | 1 |
| Cold rinse1 | Water supply(Litter) | | 2.8 | 1.12 |
| | Circulation Pump | | 2400 | 10 |
| | Target temp | Start | 35 | |
| | | End | 35 | |
| | Drain Pump | | 2800 | 1 |
| Cold rinse2 | Water supply(Litter) | | 미실시 | |
| | Circulation Pump | | | |
| | Target temp | Start | | |
| | | End | | |
| | Drain Pump | | | |
| Hot rinse | Water supply(Litter) | | 2.8 | 1.12 |
| | Circulation Pump | | 2400 | 20 |
| | Target temp | Start | 30 | |
| | | End | 48 | |
| | Drain Pump | | 2800 | 1 |
| Dry | | | | 80 |

FIG. 12

| TEMPERATURE SECTION | HEATING EFFICIENCY (H=wh/℃) |
|---|---|
| 0~20 | 14.5 |
| 20~40 | 15.1 |
| 40~60 | 16.4 |
| 60~80 | 17.5 |

FIG. 15

| ELECTRIC COMPONENT | WATER SUPPLY VALUE | DISTRIBUTOR | DRYER |
|---|---|---|---|
| CONSUMPTION POWER (W) | 5 | 8 | 5 |

TERMINAL DEVICE, DISHWASHER, TERMINAL DEVICE CONTROL METHOD, AND DISHWASHER CONTROL METHOD

CROSS-REFERENCE TO RELATED APPLICATIONS

This application is a continuation application, under 35 U.S.C. § 111(a), of International Patent Application No. PCT/KR2021/006323, filed on May 21, 2021, which claims priority under 35 U.S.C. 119 to Korean Patent Application No. 10-2020-0071775, filed on Jun. 12, 2020, in the Korean Intellectual Property Office, the disclosures of which are incorporated herein by reference in their entirety.

BACKGROUND

Field

The disclosure relates to a dishwasher and a terminal device capable of establishing a course of the dishwasher to serve the purpose according to a user input.

Description of Related Art

A dishwasher is a home appliance including a cabinet equipped with a washing tub, a basket for receiving dishes, a sump for storing water for washing, a nozzle for spraying the water, and a pump for supplying the water of the sump to the nozzle, for washing the dishes by spraying high-pressure water to the dishes.

A course of the dishwasher is subdivided into a washing process, a rinsing process and a drying process, and one cycle is completed with completion of the drying process. A manufacturer may offer standard courses made up of preset parameters, and the user may operate the dishwasher by selecting one of the standard courses offered by the manufacturer.

The user of the traditional dishwasher may thus only select a course offered by the manufacturer but may not be given an option of a course that exactly fits for a purpose intended by the user.

SUMMARY

According to an embodiment, a terminal device includes a display configured to display an operating condition of a default washing course of a dishwasher; an input configured to receive a command to change the operating condition of the default washing course from a user; and a controller configured to control the display to display at least one of an expected amount of power to be supplied, an expected amount of water to be supplied, and an expected time, which is changed according to a user-set washing course in response to the command received to change the operating condition of the default washing course.

The controller may determine the user-set washing course by changing a respective operating condition according to which at least one of a plurality of processes included in the operating condition of the default washing course is executed based on the command received to change the operating condition.

The operating condition of the default washing course may include at least one of revolutions per minute (rpm) of a pump, an operation time, target temperature, whether to perform a process, or whether to perform draining.

The controller may predict an amount of power consumption of each of a plurality of electric components included in the dishwasher to operate the user-set washing course, and determine a sum of amounts of power consumption of the plurality of electric components as the expected amount of power to be supplied according to the user-set washing course.

The controller may predict an amount of power consumption of a heater based on heating efficiency of the dishwasher and target temperature for each of the plurality of processes included in the user-set washing course, and predict an amount of power consumption of each of the plurality of electric components except for the heater based on an operation time and consumption power for the user-set washing course.

The controller may determine consumption power of the pump according to the user-set washing course based on rpm of the pump.

The controller may determine an expected amount of water to be supplied according to the user-set washing course based on the rpm of the pump.

The controller may control the display to display a user interface by which to change the respective operating condition of each of the plurality of processes of the default washing course.

The controller may control the display to display a recommended setting range of the operating condition of the default washing course.

The controller may control the display to display information about an effect of changing the operating condition of the default washing course.

The terminal device may further include a communication module for communicating with the dishwasher, and the controller may control the communication module to transmit information about the user-set washing course to the dishwasher.

According to an embodiment, a method of controlling a terminal device including a display and an input includes controlling the display to display an operating condition of a default washing course of a dishwasher; and controlling the display to display at least one of an expected amount of power to be supplied, an expected amount of water to be supplied, and an expected time, which is changed according to a user-set washing course in response to receiving a command to change the operating condition of the default washing course from a user.

The method of controlling the terminal device may further include determining the user-set washing course by changing a respective operating condition according to which at least one of a plurality of processes included in the operating condition of the default washing course is executed based on the command received to change the operating condition.

The operating condition of the default washing course may include at least one of rpm of a pump, an operation time, target temperature, whether to perform a process, or whether to perform draining.

The method of controlling the terminal device may further include predicting an amount of power consumption of each of a plurality of electric components included in the dishwasher to operate in the user-set washing course; and determining a sum of amounts of power consumption of the plurality of electric components as the expected amount of power to be supplied according to the user-set washing course.

The predicting of an amount of power consumption of each of a plurality of electric components may include predicting an amount of power consumption of a heater based on heating efficiency of the dishwasher and a target temperature for each of the plurality of processes included in the user-set course; and predicting an amount of power consumption of each of the plurality of electric components except for the heater based on an operation time and power consumption for the user-set washing course.

The method of controlling the terminal device may further include determining consumption power of the pump according to the user-set washing course based on rpm of the pump.

The method of controlling the terminal device may further include determining the expected amount of water to be supplied according to the user-set washing course based on the rpm of the pump.

The terminal device may further include a communication module for communicating with the dishwasher, and the method may further include controlling the communication module to transmit information about the user-set washing course to the dishwasher.

According to an embodiment, a dishwasher control system includes a dishwasher; and a terminal device including a display and an input, wherein the terminal device may determine a user-set washing course by changing an operating condition of a default washing course of the dishwasher in response to receiving a command to change the operating condition of the default washing course, display at least one of an expected amount of power to be supplied, an expected amount of water to be supplied, and an expected time, which is changed for the user-set washing course according to the changing of the operating condition of the default washing course, and transmit information about the user-set washing course to the dishwasher.

BRIEF DESCRIPTION OF THE DRAWINGS

The above and other aspects, features, and advantages of certain embodiments of the present disclosure will be more apparent from the following detailed description, taken in conjunction with the accompanying drawings, in which:

FIG. 10 is a diagram for describing an occasion when a terminal device changes a default washing course in response to a user input, according to an embodiment.

FIG. 12 is a diagram for describing an occasion when a terminal device determines an amount of power consumption of a heater, according to an embodiment.

FIG. 15 is a diagram for describing an occasion when a terminal device determines amounts of power consumption of electric components, according to an embodiment.

DETAILED DESCRIPTION

Figure 1:
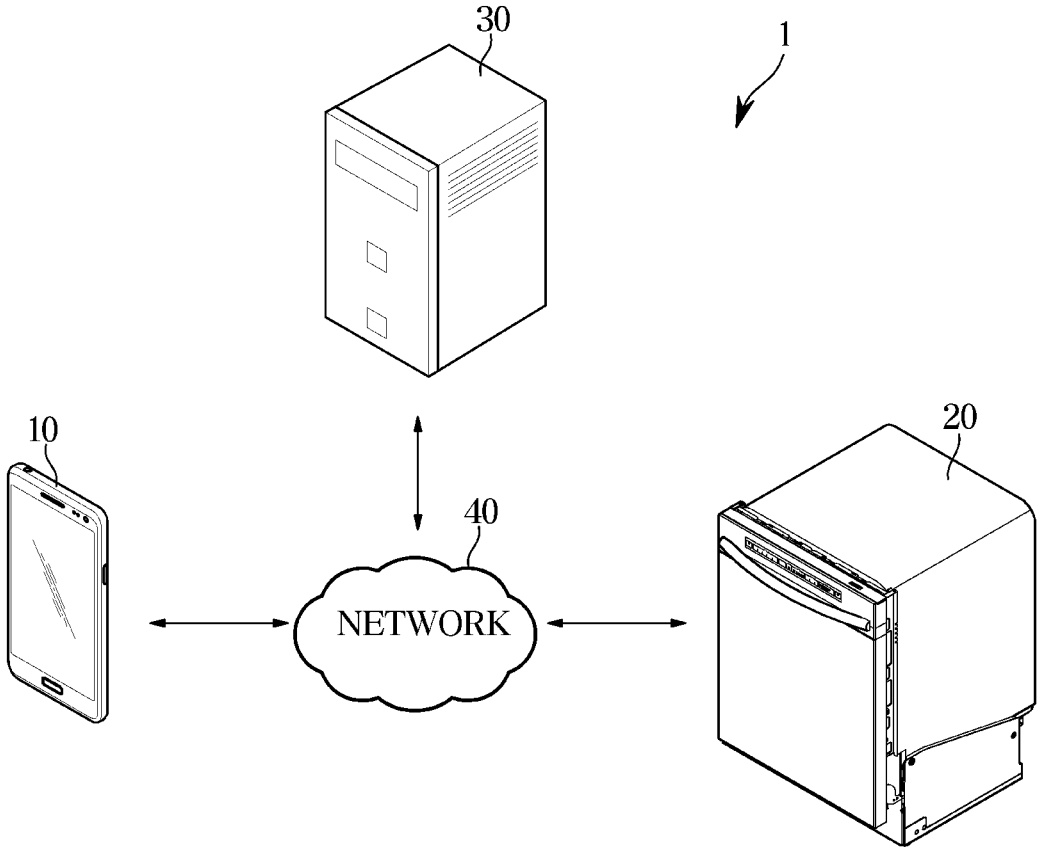
FIG. 1 illustrates a dishwasher control system, according to an embodiment.

Embodiments and features as described and illustrated in the disclosure are merely examples, and there may be various modifications replacing the embodiments and drawings at the time of filing this application.

It will be further understood that the term "connect" or its derivatives refer both to direct and indirect connection, and the indirect connection includes a connection over a wireless communication network.

The terminology used herein is for the purpose of describing particular embodiments only and is not intended to limit the disclosure. It is to be understood that the singular forms "a," "an," and "the" include plural references unless the context clearly dictates otherwise. It will be further understood that the terms "comprise" and/or "comprising," when used in this specification, specify the presence of stated features, integers, steps, operations, elements, and/or components, but do not preclude the presence or addition of one or more other features, integers, steps, operations, elements, components, and/or groups thereof.

The terms including ordinal numbers like "first" and "second" may be used to explain various components, but the components are not limited by the terms. The terms are only for the purpose of distinguishing a component from another. Thus, a first element, component, region, layer or room discussed below could be termed a second element, component, region, layer or section without departing from the teachings of the disclosure.

Furthermore, the terms, such as "~part", "~block", "~member", "~module", etc., may refer to a unit of handling at least one function or operation. For example, the terms may refer to at least one process handled by hardware such as field-programmable gate array (FPGA)/application specific integrated circuit (ASIC), etc., software stored in a memory, or at least one processor.

Reference numerals used for method steps are just used to identify the respective steps, but not to limit an order of the steps. Thus, unless the context clearly dictates otherwise, the written order may also be practiced otherwise.

The disclosure provides a dishwasher and a terminal device which creates a washing course that serves a purpose of use based on a user input and provides an expected amount of power and an expected amount of water to be supplied for the created washing course.

According to an embodiment of a terminal device and a dishwasher, more options of washing course may be provided for the user by creating a washing course to fit for a purpose of use based on a user input and providing an expected amount of power and an expected amount of water to be supplied for the created washing course.

Reference will now be made in detail to embodiments of the disclosure, which are illustrated in the accompanying drawings.

FIG. 1 illustrates a dishwasher control system, according to an embodiment.

Referring to FIG. 1, a dishwasher control system 1 according to an embodiment includes a terminal device 10, a dishwasher 20, a server 30 and a network 40.

In an embodiment, the terminal device 10 may include a communication module to perform communication with the dishwasher 20 and the server 30 through a known radio communication protocol, and may correspond to a user equipment capable of receiving an input from the user. For example, the terminal device 10 may correspond to a user equipment such as a smart phone, and there is no limitation on the terminal device 10 as long as the user equipment is able to perform wireless communication and receive an input from the user.

In an embodiment, the terminal device 10 may receive a command to operate the dishwasher 20 from the user and forward the input operation command to the dishwasher 20, so that the dishwasher 20 operates according to the operation command input from the user.

Furthermore, in an embodiment, the terminal device 10 may receive a command to change an operating condition of a default washing course of the dishwasher 20 from the user, and determine a user-set course by changing the operating condition of the default washing course based on the input command for changing. In this case, the terminal device 10 may transmit information about the user-set course to the dishwasher 20 so that the dishwasher 20 may operate according to the user-set course.

In an embodiment, the terminal device 10 may determine an expected amount of power, an expected amount of water to be supplied, and an expected time of the user-set course based on table information, and display the determined expected amount of power, expected amount of water to be supplied and expected time. In this case, the terminal device 10 may receive the table information from the server 30 and store the table information in advance.

Furthermore, in an embodiment, the terminal device 10 may transmit the user-set course to the server 30 and request an expected amount of power, an expected amount of water to be suppled and an expected time for the user-set course from the server 30. In this case, the terminal device 10 may display the expected amount of power, the expected amount of water to be supplied, the expected time for the user-set course based on information received from the server 30.

In an embodiment, the dishwasher 20 may operate based on an operation command input from the user. For example, the dishwasher 20 may operate based on an operation command input through an input device provided on the main body or through the terminal device 10.

Furthermore, in an embodiment, the dishwasher 20 may operate based on the user-set course received from the terminal device 10.

In an embodiment, the server 30 may transmit, to the terminal device 10, an expected amount of power, an expected amount of water to be supplied and an expected time changed by changing the operating condition.

Moreover, in an embodiment, the server 30 may determine the expected amount of power, the expected amount of water to be supplied, the expected time for the user-set course based on the information about the user-set course received from the terminal device 10, and transmit the determined expected amount of power, expected amount of water to be supplied and expected time to the terminal device 10.

In an embodiment, the network 40 may include at least one of telecommunication networks, e.g., computer networks (e.g., local area network (LAN) or wide area networks (WAN)), the Internet, or telephone networks.

In an embodiment, each of the terminal device 10, the dishwasher 20 and the server 30 may be wiredly or wirelessly connected to the network 40 to transmit or receive information to or from one another. Alternatively, the terminal device 10 and the dishwasher 20 may be directly connected to each other and directly communicate with each other without going through the network 40.

In an embodiment, the dishwasher 20 may receive a command to change an operating condition of a default washing course from the user in the same way as the terminal device 10, determine a user-set course by changing the operating condition of the default washing course based on the received command for changing, and display an expected amount of power, expected amount of water to be supplied and expected time for the user-set course.

An embodiment in which the terminal device 10 determines a user-set course and displays the expected amount of power, expected amount of water to be supplied and expected time will now be focused, without excluding an embodiment in which the dishwasher 20 determines a user-set course and displays expected information.

Figure 2:
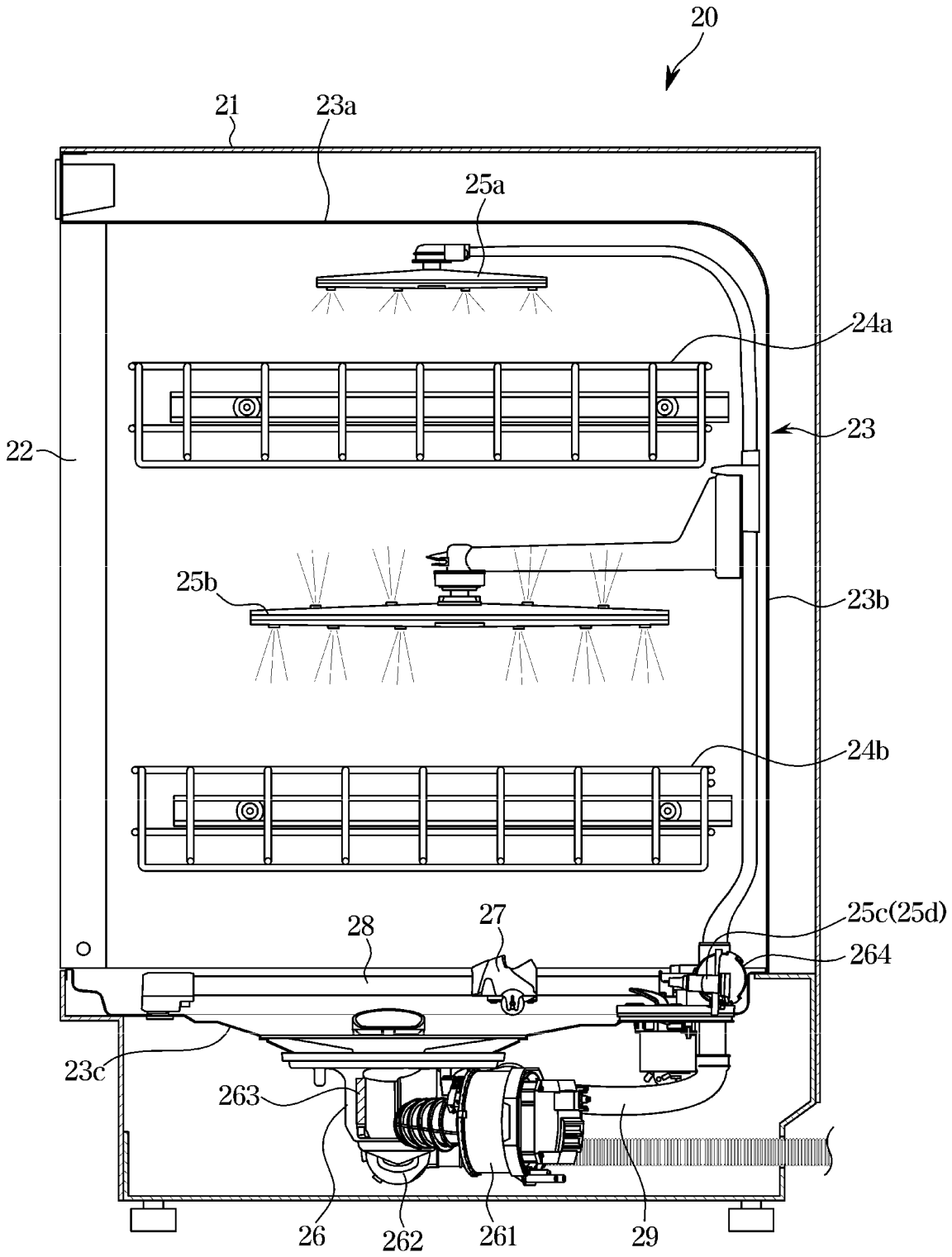
FIG. 2 is a side cross-sectional view of a dishwasher, according to an embodiment.

FIG. 2 is a side cross-sectional view of the dishwasher 20, according to an embodiment.

Referring to FIG. 2, the dishwasher 20 in an embodiment may include a cabinet 21 forming an exterior, a door 22 provided on the front of the cabinet 21, a washing tub 23 provided in the cabinet 21, baskets 24 (24*a* and 24*b*) provided in the washing tub 23, nozzles 25 (25*a*, 25*b*, 25*c* and 25*d*) provided to spray water for washing, a sump 26 provided to store the water, and a plurality of electric components 260 (261, 262, 263 and 264) for performing washing courses.

The washing tub 23 may have the shape of substantially a box with an open front through which to take in or out the dishes. Specifically, the washing tub 23 may include a top wall 23*a*, a left wall (not shown), a right wall (not shown), a rear wall 23*b* and a bottom plate 23*c*. The open front of the washing tub 23 may be opened or closed by the door 22.

The baskets 24 may be formed of wires to support dishes and allow passage of water. In an embodiment, the baskets 24 may be arranged in two rows including an upper basket 24*a* and a lower basket 24*b*. The number of the baskets 24 is not, however, limited thereto, and other various number of baskets may be provided in some other embodiments.

In an embodiment, the nozzles 25 may include an upper rotary nozzle 25*a*, a middle rotary nozzle 25*b*, a lower left stationary nozzle 25*c* and a lower right stationary nozzle 25*d*.

The upper rotary nozzle 25*a* may spray water downwards while rotating under water pressure. The middle rotary nozzle 25*b* may spray water upwards and downwards while rotating under water pressure. Water sprayed by the upper rotary nozzle 25*a* and the middle rotary nozzle 25*b* may be sprayed toward the dishes placed in the baskets 24*a* and 24*b*. The water sprayed by the upper rotary nozzle 25*a* and the middle rotary nozzle 25*b* may come into direct contact with the dishes.

The lower left stationary nozzle 25*c* and the lower right stationary nozzle 25*d* may be fixed on the left and right sides, respectively, in the back and bottom of the washing tub 23. The lower left stationary nozzle 25*c* and the lower right stationary nozzle 25*d* may spray water forwards. The water sprayed by the lower left stationary nozzle 25*c* and the lower right stationary nozzle 25*d* may be sprayed toward a reflecting plate 27. The reflecting plate 27 may linearly reciprocate forwards and backwards, and may reflect the water sprayed from the lower left stationary nozzle 25*c* and the lower right stationary nozzle 25*d* upwards.

The reflecting plate 27 may be guided by a rail 28 that extends long from front to back. The reflecting plate 27 may be moved by receiving driving force from an extra driver.

The positions and number of the nozzles 25 are not, however, limited thereto, and have no limitations as long as the positions and numbers of the nozzles 25 allow water to be sprayed to dishes placed in the washing tub 23.

The sump 26 is provided to store water. The sump 26 may be arranged in substantially the center of the bottom plate 23*c* of the washing tub 23. The bottom plate 23*c* of the washing tub 23 may be formed to slope toward the sump 26 so that water falling onto the bottom plate 23*c* flows into the sump 26. The sump 26 may receive water from an external water source (not shown) in the beginning of operation of the dishwasher.

The plurality of electric components 260 may include a circulation pump 261 provided to circulate the water of the sump 26, a drain pump 262 provided to discharge the water of the sump 26 with dirt to the outside of the cabinet 21, a heater 263 for heating the water in the sump 26, and a distributor 264 for distributing the water to the nozzles 25*a*, 25*b*, 25*c* and 25*d*.

The circulation pump 261 is provided to circulate the water from the sump 26. The circulation pump 261 may pump the water stored in the sump 26 and supply the water to the distributor 264 through a circulation flow path 29.

The distributor 264 may distribute the water supplied from the sump 26 through the circulation flow path 29 to the nozzles 25*a*, 25*b*, 25*c* and 25*d*. The distributor 264 may have various combinations of modes to distribute or not distribute the water to the nozzles 25*a*, 25*b*, 25*c* and 25*d*.

For example, the distributor 264 may have a supply mode to supply water to one of the nozzles 25*a*, 25*b*, 25*c* and 25*d*, and an all-blocking mode not to supply water to any of the nozzles 25*a*, 25*b*, 25*c* and 25*d*. The distributor 264 may enable divided washing by allowing the water to be sprayed only by the upper nozzle 25*a*, only by the middle nozzle 25*b*, only by the left stationary nozzle 25*c* or only by the right stationary nozzle 25*d*.

The distributor 264 may be formed of various well-known components. For example, the distributor 264 may include a housing shaped like a cylinder and a cylindrical rotary member provided to be rotatable in the housing. The housing may have an inlet connected to the circulation flow path 29 and a plurality of outlets connected to the respective nozzles 25*a*, 25*b*, 25*c* and 25*d*. The rotary member may have a plurality of internal flow paths separated from one another.

The internal flow path may be formed to extend from the inlet to one of the plurality of outlets. Alternatively, the internal flow path may be formed to extend from the inlet to two or more of the plurality of outlets.

The distributor 264 may be provided in the washing tub 23. Accordingly, the distributor 264 is located higher than the sump 26. Hence, the water not distributed from the distributor 264 to the nozzles 25*a*, 25*b*, 25*c* and 25*d* may flow into the sump 26 by the self-weight and there may be no water left in the distributor 264.

With this mechanism, the circulation pump 261 is activated to pump the water in the sump 26 to the nozzle 25*a*, 25*b*, 25*c* and 25*d*, from which the water may be sprayed to wash the dishes. Water that has washed the dishes and fallen may be collected in the sump 26 along the slope of the bottom plate 23*c* of the washing tub 23 and may be circulated again by the pumping of the circulation pump 261.

The drain pump 262 is provided to discharge the water stored in the sump 26 to the outside of the dishwasher cabinet 21. The drain pump 262 may usually drain the water stored in the sump 26 after completion of each washing process such as pre-washing, main washing, rinsing, etc.

In general, the dishwasher 20 may perform a pre-washing process, a main washing process, a rinsing process and a drying process in one washing course. In other words, one washing course (or one washing cycle) may be comprised of a pre-washing process, a main washing process, a rinsing process and a drying process.

The washing process (the pre-washing process and the main washing process) corresponds to a process of spraying water for washing that contains a detergent to the dishes, and the rinsing process corresponds to a process of spraying water for rinsing that contains a rinse agent to the dishes. For this, the dishwasher 20 may include a detergent feeder (not shown) and a rinse feeder (not shown).

Furthermore, the rinsing process may be comprised of cold rinsing that uses cold water and hot rinsing that uses hot water for drying. In this case, the dishwasher 20 may control the heater 263 to heat the water stored in the sump 26 to perform hot rinsing.

Furthermore, the dishwasher 20 may include a dryer (not shown) that sucks in air from the outside of the washing tub 23 and releases the air into the washing tub 23 for the drying process. Specifically, the dryer may include a blower fan to supply air toward the dishes placed in the washing tub 23 during the drying process to facilitate drying of the dishes. In an embodiment, the dryer may be attached to a side wall of the washing tub 23, and an opening may be formed on the side wall of the washing tub 23, to which the dryer is attached, for the air discharged from the dryer to flow into the washing tub 23.

The dishwasher 20 may perform a pre-washing process, a main washing process, a rinsing process and a drying process based on a washing course having operating conditions (e.g., pump rpm, an operation time, target temperature, whether to perform the process, etc.) preset by the manufacturer. In other words, the dishwasher 20 may perform each process based on operating conditions pre-stored for each process of the washing course.

The user of the traditional dishwasher is only allowed to select a course offered by the manufacturer but may not be given an option of a course that exactly serves a purpose desired by the user.

In an embodiment, the dishwasher 20 may perform a washing course established by the user by receiving, from the terminal device 10, a user-set course for which the user changes an operating condition to fit for a purpose. Accordingly, the dishwasher 20 may provide a washing course desired by the user.

An embodiment of creating a user-set course by changing an operating condition of a washing course through the terminal device 10 will now be described in detail.

Figure 3:
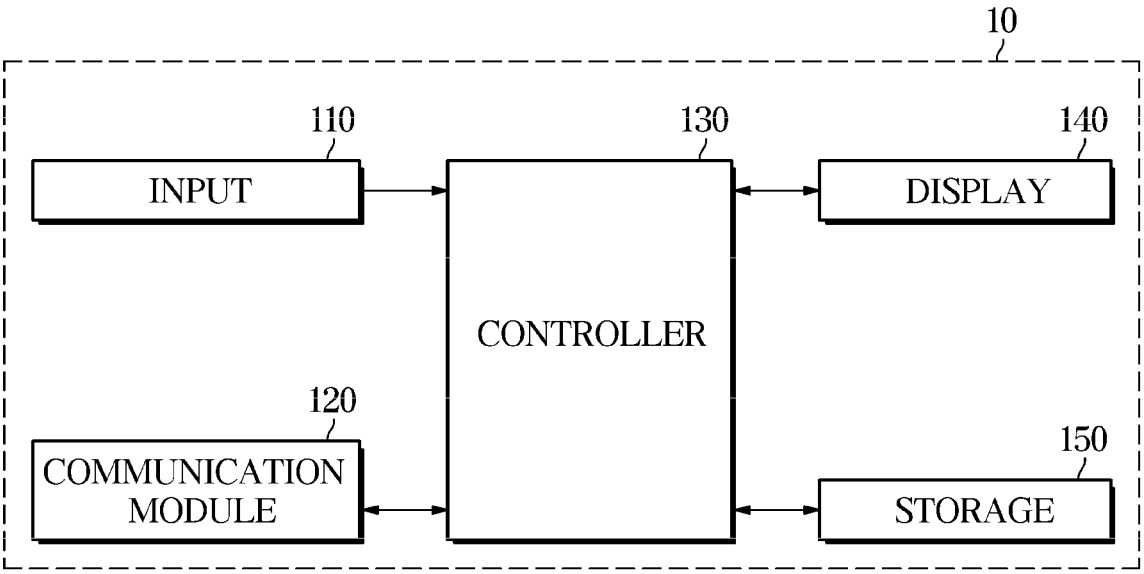
FIG. 3 is a control block diagram of a terminal device, according to an embodiment.

FIG. 3 is a control block diagram of the terminal device 10, according to an embodiment of the disclosure.

Referring to FIG. 3, in an embodiment, the terminal device 10 may include an input 110 for receiving an input from the user, a communication module 120 for communicating with the dishwasher 20 and the server 30, a controller 130 for determining a user-set course by changing an operating condition based on a command for changing input from the user and determining an expected amount of power, an expected amount of water to be supplied, an expected time for the user-set course, a display 140 for displaying the expected amount of power, the expected amount of water to be supplied, and the expected time for the user-set course, and a storage 150 for storing various information required for control.

The input 110 may receive an input from the user.

The input 110 may receive a command from the user to change a default washing course of the dishwasher 20. Specifically, the input 110 may receive a command to change an operating condition of the default washing course. For example, the input 110 may receive a command to change an operating condition of each of the plurality of processes included in the default washing course.

In this case, the operating condition is a condition under which a process of the default washing course is operated, and may include rpm of a pump (the circulation pump 261 or the drain pump 262) in the process, an operation time of the process, target temperature for the process, whether to perform the process, whether to perform draining, etc., in an embodiment.

Specifically, the user may input a command through the input 110 to change at least one of the pump rpm, the operation time, the target temperature for each process of the default washing course or whether to perform the process.

The input 110 may be provided as an input device of a type known to the public to receive an input from the user, and in an embodiment, may be provided as a touchscreen integrally formed with the display 140. An example in which the input 110 is provided as a touchscreen will now be described, but embodiments of the disclosure are not limited thereto.

In an embodiment, the communication module 120 may communicate with the dishwasher 20 and the server 30.

The communication module 120 may transmit an operation command input from the user to the dishwasher 20.

The communication module 120 may also transmit information about a user-set course created based on the command to change an operating condition input from the user to the dishwasher 20.

Furthermore, the communication module 120 may receive table information required to determine an expected amount of power, an expected amount of water to be supplied and an expected time for the user-set course from the server 30.

For this, the communication module 120 may include a known type of communication module, and may use a known type of communication protocol to transmit or receive information to or from an external electronic device such as the dishwasher 20 and the server 30.

In an embodiment, the controller 130 may determine a user-set course by changing an operating condition of the default washing course based on a command to change the operating condition input from the user.

Specifically, the controller 130 may determine a user-set course by changing an operating condition of at least one of a plurality of processes included in the default washing course based on a command to change the operating condition.

In this case, the controller 130 may control the display 140 to display a user interface by which to change an operating condition of each of the plurality of processes of the default washing course. Accordingly, the user may input a command to change the operating condition according to the user interface displayed on the display 140.

In an embodiment, the controller 130 may control the display 140 to display a recommended setting range of an operating condition. The user may change the operating condition to have a value in the recommended setting range, and accordingly, may determine a user-set course as a washing course that fits for a purpose of use of the user and has high washing efficiency.

Furthermore, in an embodiment, the controller 130 may control the display 140 to display information about an effect of changing the operating condition. Accordingly, the user may figure out a washing effect according to the changing of the operating condition, and may input a command to change the operating condition based on the washing effect intended by the user.

In an embodiment, the controller 130 may control the communication module 120 to transmit information about a user-set course to the dishwasher 20 when the user-set course is determined. Accordingly, the terminal device 10 may allow the dishwasher 20 to operate according to the user-set course.

In an embodiment, the controller 130 may determine an expected amount of power, an expected amount of water to be supplied, and an expected time for the user-set course, and control the display 140 to display the determined expected amount of power, expected amount of water to be supplied, and expected time.

For example, the controller 130 may control the display 140 to display the changed expected amount of power, expected amount of water to be supplied, and expected time when the command to change the operating condition of the default washing course is input. In other words, the controller 130 may control the display 140 to display the expected amount of power, expected amount of water to be supplied, and expected time changed when the default washing course is changed to the user-set course.

The controller 130 may predict an amount of power consumption of each of the plurality of electric components 260 included in the dishwasher 20 for the user-set course, and determine a sum of amounts of power consumption of the plurality of electric components to be the expected amount of power for the user-set course.

The controller 130 may predict an amount of power consumption of the heater 263 based on target temperature and heating efficiency of the dishwasher 20 for each of the plurality of processes included in the user-set course, and predict an amount of power consumption of each of the plurality of electric components 260 except for the heater 263 based on the operation time and consumption power for the user-set course.

In this case, the controller 130 may determine consumption power of the pump 261 or 262 based on the rpm of the pump 261 or 262, and predict an amount of power consumption of the pump 261 or 262 for the user-set course based on the determined consumption power and the operation time of the pump 261 or 262.

In an embodiment, the controller 130 may determine an expected amount of water to be supplied based on the rpm of the circulation pump 261. Specifically, the controller 130 may determine an expected amount of water to be supplied for the user-set course based on the information about the amount of water to be supplied according to the rpm of the circulation pump 261 and the rpm of the circulation pump 261 set for the user-set course.

In an embodiment, the controller 130 may determine an expected time of the user-set course based on the operation time of the default washing course and a command input from the user to change the operation time.

As such, the terminal device 10 may allow the user to intuitively recognize the information about a course established by the user and select the course more easily by displaying the expected amount of power, the expected amount of water to be supplied and the expected time for the user-set course based on the command for changing input from the user.

Furthermore, in an embodiment, the controller 130 may control the communication module 120 to transmit a user-set course to the server 30 when the user-set course is determined, and request an expected amount of power, an expected amount of water to be supplied, and an expected time for the user-set course from the server 30 through the communication module 120. In this case, the controller 130 may control the display 140 to display the expected amount of power, the expected amount of water to be supplied, the expected time for the user-set course based on information received from the server 30.

The controller 130 may include at least one memory for storing a program for carrying out the aforementioned and following operations, and at least one processor for executing the program.

In an embodiment, the display 140 may display operating conditions of the default washing course and display a user interface to change an operating condition of each of the plurality of processes of the default washing course under the control of the controller 130.

In an embodiment, the display 140 may display operating conditions of the user-set course and display an expected amount of power, an expected amount of water to be supplied, and an expected time for the user-set course under the control of the controller 130.

For this, the display 140 may be implemented as a known type of display panel, or may be implemented as a touchscreen integrally formed with the input 110.

In an embodiment, the storage 150 may be implemented as a known type of storage medium that stores various information required for control such as information about the default washing course.

The storage 150 may store table information received from the server 30. Specifically, the storage 150 may store information about heating efficiency of the dishwasher 20, information about consumption power of each of the electric components 260 of the dishwasher 20, information about consumption power of the pump 261 or 262 depending on the rpm, information about an amount of water to be supplied depending on rpm of the circulation pump 261, etc.

Elements of the terminal device 10 have thus far been described. Elements of the dishwasher 20 will now be described.

Figure 4:
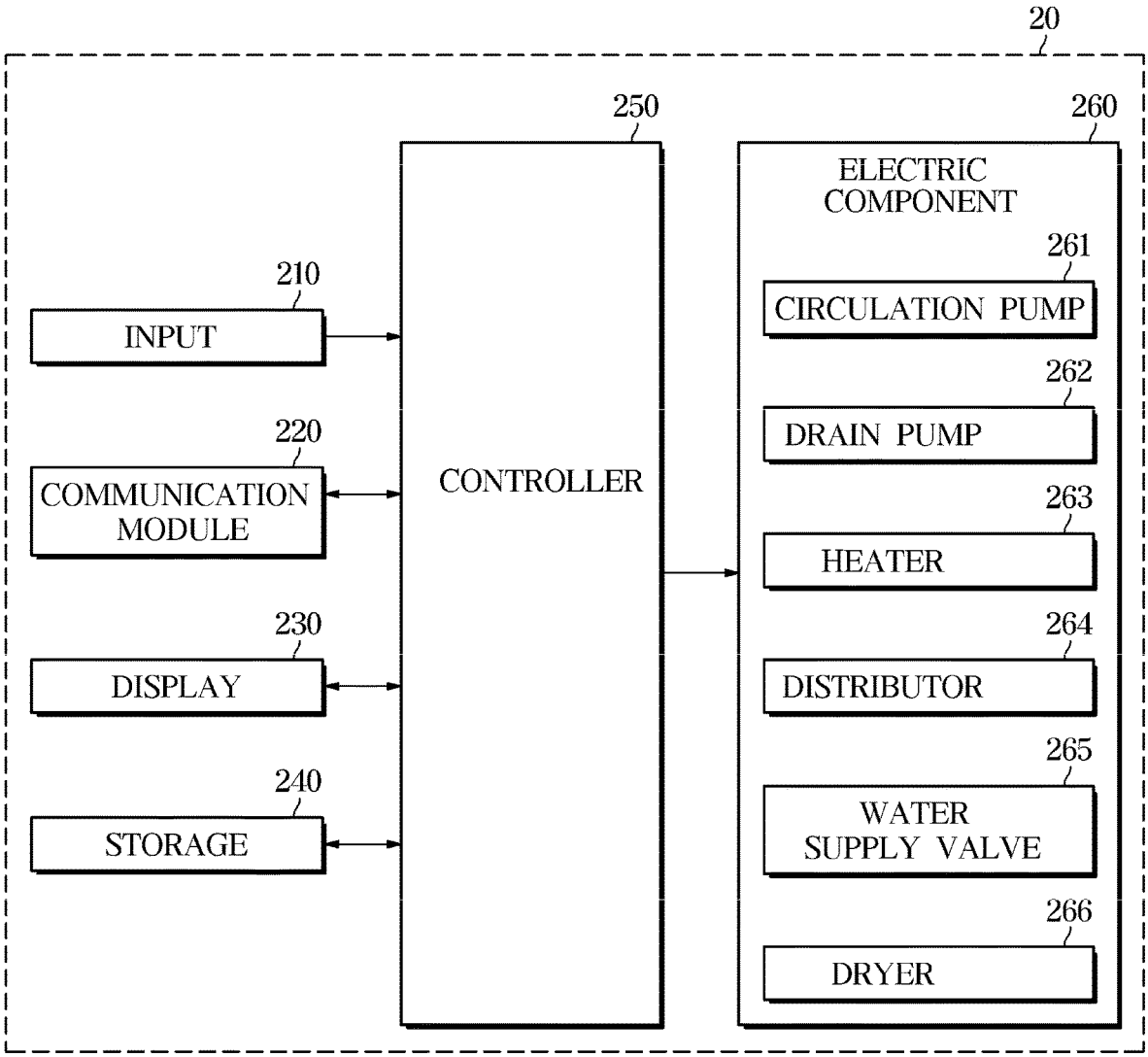
FIG. 4 is a control block diagram of a dishwasher, according to an embodiment.

FIG. 4 is a control block diagram of the dishwasher 20, according to an embodiment.

Referring to FIG. 4, the dishwasher 20 includes an input 210 for receiving an input from the user, a communication module 220 for communicating with the terminal device 10 and the server 30, a display 230, a storage 240 for storing various information required for control, a controller 250 for controlling a washing course to be performed, and electric components 260 for performing the washing course.

In an embodiment, the input 210 may be provided as a known type of input device to receive an input from the user, and in an embodiment, may be provided as a touchscreen integrally formed with the display 230.

Specifically, the input 210 may include a power button, a button to select a washing course, a button to select an option, a button to set up a reservation, a button to start or stop operation, etc.

For example, the input 210 may receive a selection for a user-set course from the user, and receive a command to start or stop operation of the user-set course.

In an embodiment, the communication module 220 may include a known type of communication module, and may use a known type of communication protocol to transmit or receive information to or from an external electronic device such as the terminal device 10 and the server 30.

For example, the communication module 220 may receive information about a user-set course from the terminal device 10.

In an embodiment, the display 230 may display information about the selected washing course, information about the selected option, a remaining time of the washing course being performed in the dishwasher 20, etc.

For this, the display 230 may be implemented as a known type of display panel, or may be implemented as a touchscreen integrally formed with the input 210.

In an embodiment, the storage 240 may store various information required for control such as information about operating conditions for each washing course, and for this, may be implemented with a known type of storage medium.

In an embodiment, the controller 250 may control the plurality of electric components 260 to perform washing based on a washing course selected based on a user input.

For example, in response to receiving a selection for a user-set course, the controller 250 may control the plurality of electric components 260 to perform washing based on the user-set course.

The controller 250 may include at least one memory for storing a program for carrying out the aforementioned and following operations, and at least one processor for executing the program.

In an embodiment, the electric components 260 may include the circulation pump 261 provided to circulate water for washing of the sump 26, the drain pump 262 provided to drain the water of the sump 26 with dirt to the outside of the cabinet 21, the heater 263 for heating the water in the sump 26, the distributor 264 for distributing the water to the nozzles 25*a*, 25*b*, 25*c* and 25*d*, a water supply valve 265 for controlling supply of water to the sump 26 from an external water supply source or an internal tank, and a drier 266 that sucks in air from the outside of the washing tub 23 and discharges the air into the washing tub 23.

Although it is described that the electric components 260 include the circulation pump 261, the drain pump 262, the heater 263, the distributor 264, the water supply valve 265 and the dryer 266, types of the electric components 260 are not limited thereto and the electric components 260 may be of any type as long as the type of the component consumes power to perform a washing course.

As described above, the elements of the dishwasher 20 may perform a user-set course based on information about the user-set course received from the terminal device 10.

Alternatively, in some embodiments, the dishwasher 20 may directly determine and perform the user-set course based on a user input without receiving the user-set course from the terminal device 10.

Specifically, in an embodiment, the input 210 may receive a command to change an operating condition of the default washing course from the user, and the controller 250 may determine a user-set course by changing the operating condition of the default washing course based on the command to change the operating condition. Furthermore, in an embodiment, the controller 250 may determine an expected amount of power, an expected amount of water to be supplied, and an expected time for the user-set course, and control the display 230 to display the determined expected amount of power, expected amount of water to be supplied, and expected time.

As such, the elements of the dishwasher 20 may perform functions corresponding to the respective elements of the terminal device 10.

An embodiment in which the terminal device 10 determines a user-set course and displays the expected amount of power, expected amount of water to be supplied and expected time will now be focused, but it is also possible that the dishwasher 20 determines a user-set course based on technical features as will be described below and displays the expected amount of power, expected amount of water to be supplied and expected time.

Figure 5:
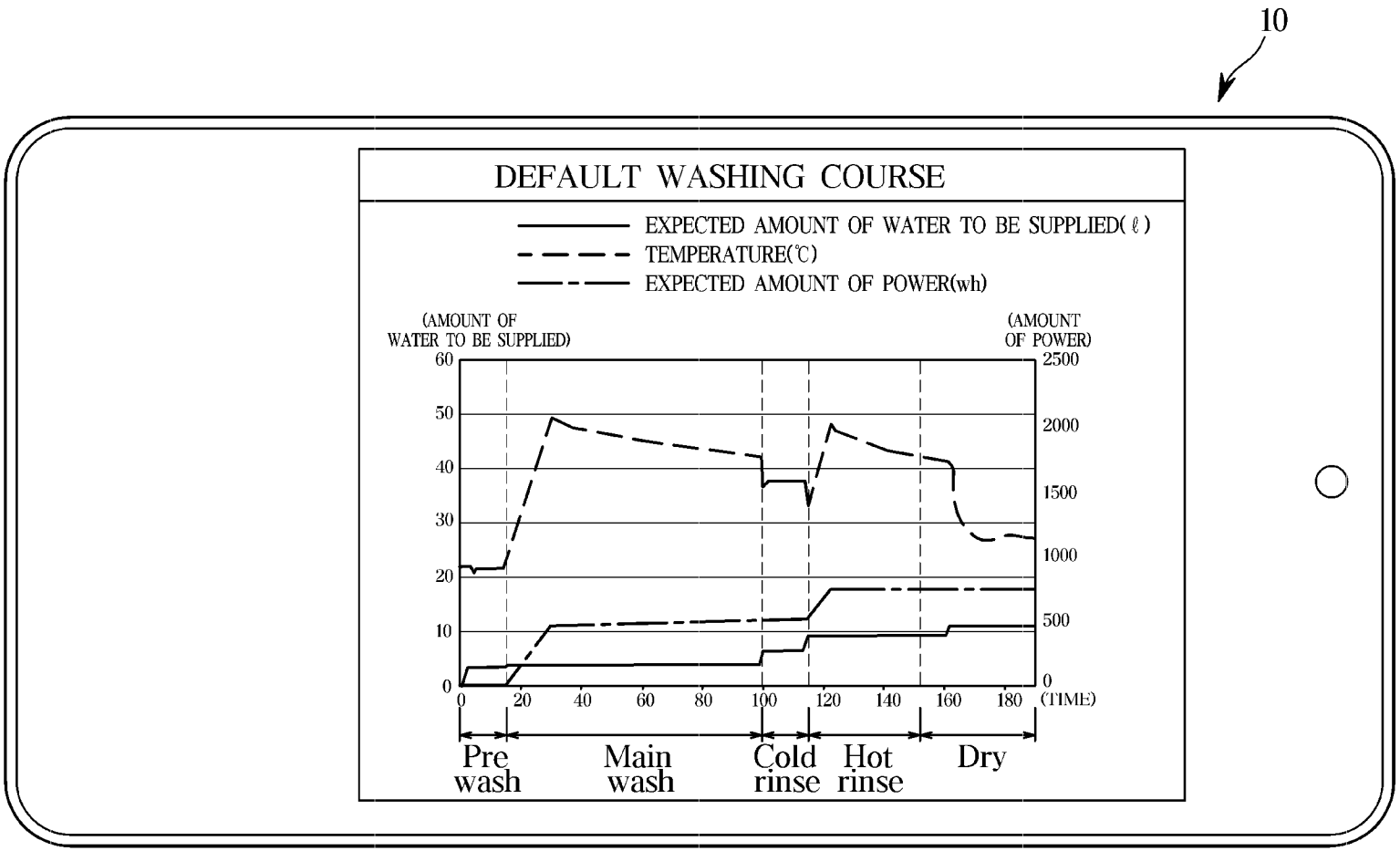
FIG. 5 illustrates a terminal device displaying operating conditions of a default washing course, according to an embodiment.

FIG. 5 illustrates the terminal device 10 displaying operating conditions of a default washing course, according to an embodiment.

Referring to FIG. 5, the terminal device 10 may display operating conditions of a default washing course. In this case, the default washing course may be a type of washing course offered by the manufacturer, which may become a reference for changing. In other words, the user may determine a user-set course that fits for a purpose of use by changing an operating condition of the default washing course.

For example, as shown in FIG. 5, as operating conditions of a default washing course, the terminal device 10 may display types of processes to be performed, an operation time for each process and a target temperature for each process in graphs.

The composition of the operating conditions of the default washing course displayed by the terminal device 10 is not limited to this example, and the terminal device 10 may display operating conditions such as the type of the process being performed, rpm of the pump 261 or 262 in each process, an operation time for each process, target temperature for each process, etc., in the form of a table.

As such, there is no limitation to the form in which the terminal device 10 displays operating conditions of the default washing course, and any form that may visually present the operating conditions of the default washing course to the user may be equally applied.

The terminal device 10 may display an expected amount of power, an expected amount of water to be supplied and an expected time for the default washing course as shown in FIG. 5 according to an embodiment.

In this case, the user may establish a user-set course by changing an operating condition of each process of the default washing course.

For this, the controller 130 may control the display 140 to display a user interface by which to change an operating condition of each of the plurality of processes of the default washing course. Accordingly, the user may input a command to change the operating condition according to the user interface displayed on the display 140.

The user interface by which to change an operating condition of the default washing course will now be described in detail.

Figure 6:
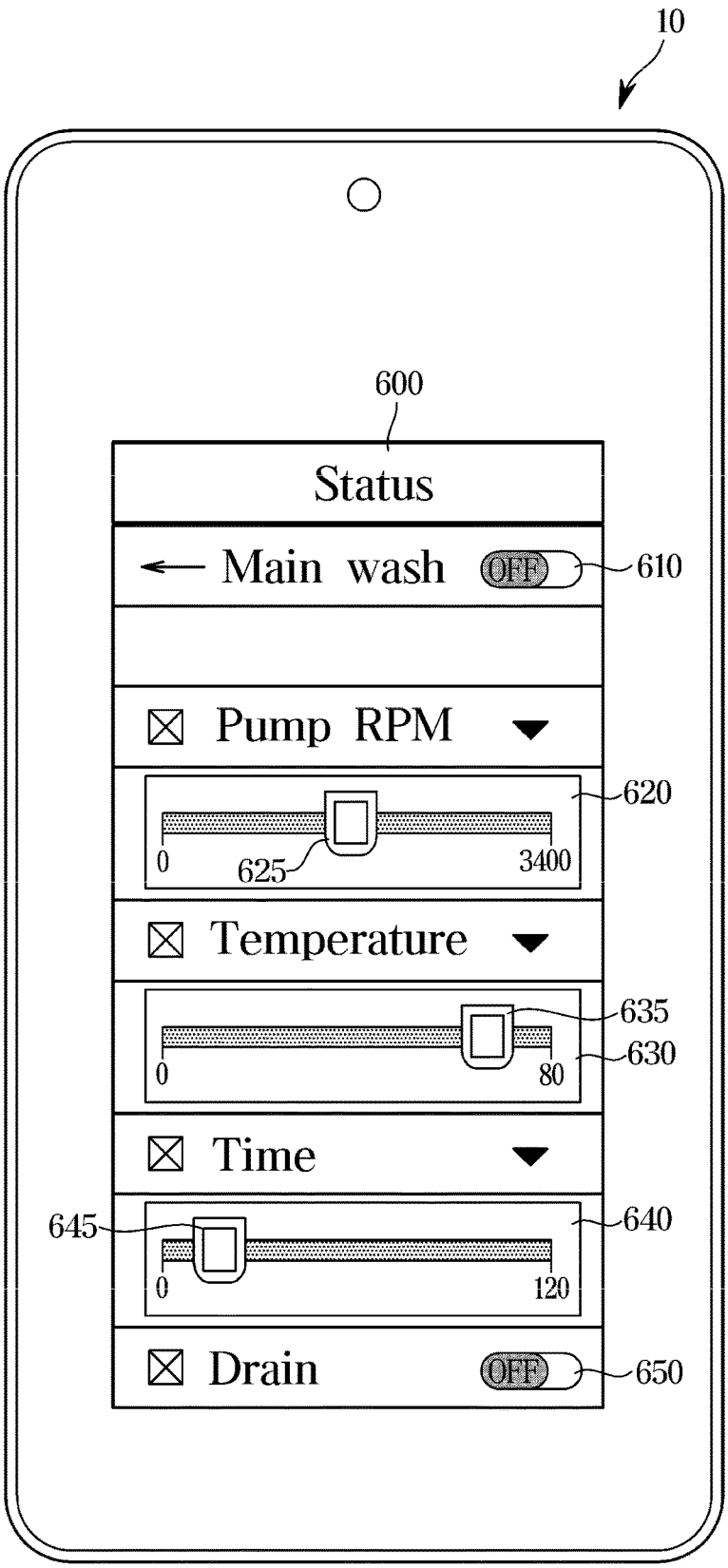
FIGS. 6 and 7 illustrate a terminal device displaying a user interface for operating conditions of a default washing course, according to an embodiment.
Figure 7:
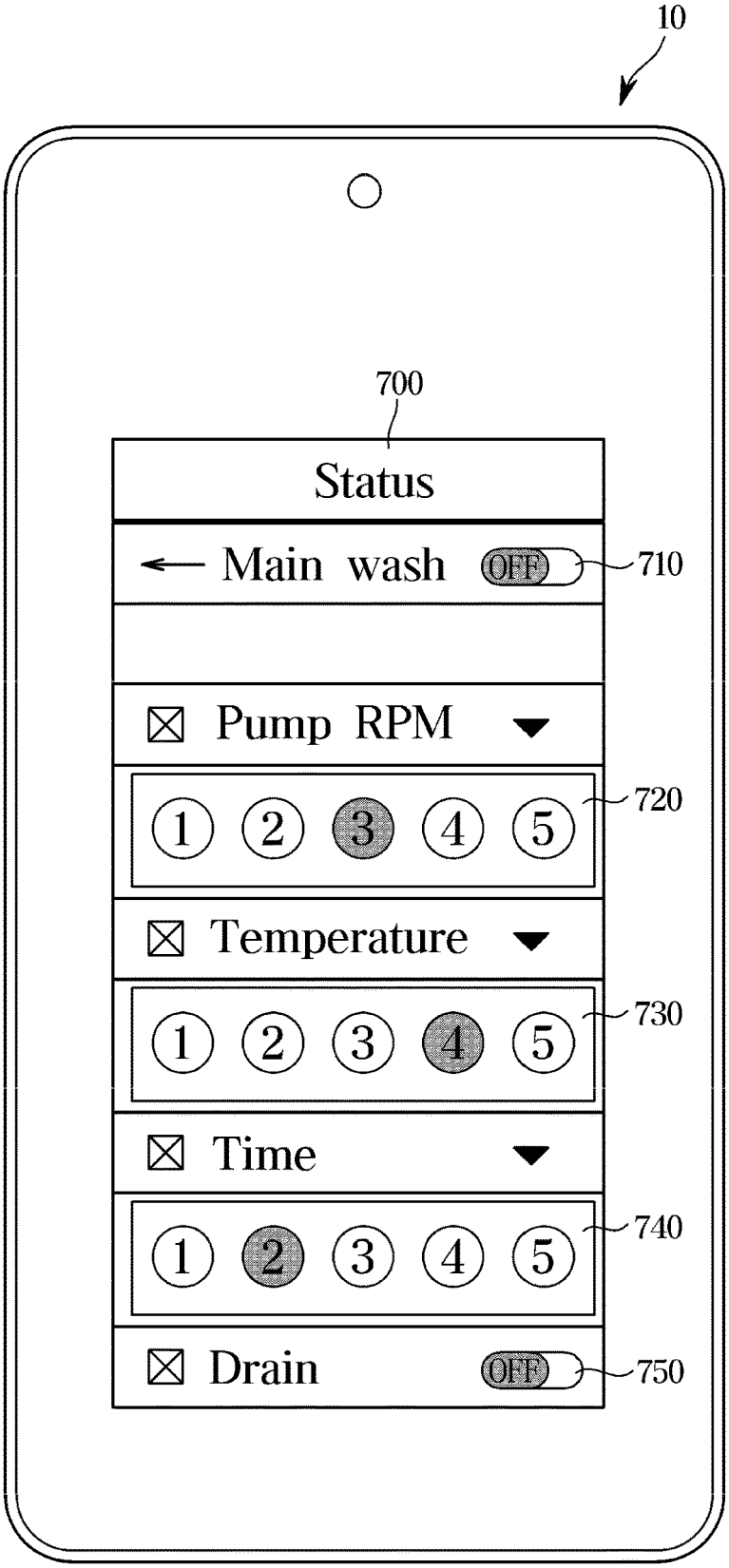

FIGS. 6 and 7 illustrate the terminal device 10 displaying a user interface for operating conditions of a default washing course, according to an embodiment.

In an embodiment, the terminal device 10 may display a user interface by which to change an operating condition of each of the plurality of processes of the default washing course.

Specifically, the terminal device 10 may provide the user interface by which to change the rpm of the pump 261 or 262, the operation time, the target temperature, whether to perform a process and whether to perform draining for each of a plurality of processes (a pre-washing process, a main washing process, a cold rinsing process, a hot rinsing process, and a drying process).

For example, the terminal device 10 may receive a selection of one of the plurality of processes of the default washing course from the user through the input 110, and may provide the user interface by which to change an operating condition of the selected process. In an embodiment, the terminal device 10 may display a user interface by which to simultaneously change operating conditions of the plurality of processes.

As shown in FIG. 6, the terminal device 10 may provide a user interface 600 having the form of slide bars to change operating conditions of each process.

For example, the user interface 600 may include a button 610 to change whether to perform the main washing process, a slide bar 620 to change the rpm of the pump 261 or 262 in the main washing process, a slide bar 630 to change the target temperature for the main washing process, a slide bar 640 to change an operation time for the main washing process, and a button 650 to change whether to perform draining.

In this case, the user may change the rpm of the pump 261 or 262, the target temperature and the operation time by adjusting positions of indicators 625, 635 and 645 on the slide bars 620, 630 and 640 through the input 110.

Furthermore, as shown in FIG. 7, the terminal device 10 may provide a user interface 700 having the form to select stages of operating conditions of each process.

For example, the user interface 700 may include a button 710 to change whether to perform the main washing process, a stage selection window 720 to change the rpm of the pump 261 or 262 in the main washing process, a stage selection window 730 to change the target temperature for the main washing process, a stage selection window 740 to change an operation time for the main washing process, and a button 750 to change whether to perform draining.

In this case, the user may change the rpm, the target temperature and the operation time of the pump 261 or 262 by selecting one of stage ①, stage ②, stage ③, stage ④ and stage ⑤ on the stage selection windows 720, 730 and 740 through the input 110. However, the number of stages may be variously set by the user.

An example of the user interface 600 or 700 for changing operating conditions of each process of the default washing course has thus far been described. The user interface for changing operating conditions is not, however, limited to the above example, and any user interface that is able to receive a user input to change an operating condition may be equally applied without limitation.

For convenience of explanation, an example in which a user interface is provided as the user interface 600 having the form of slide bars to change operating conditions will now be described.

Figure 8:
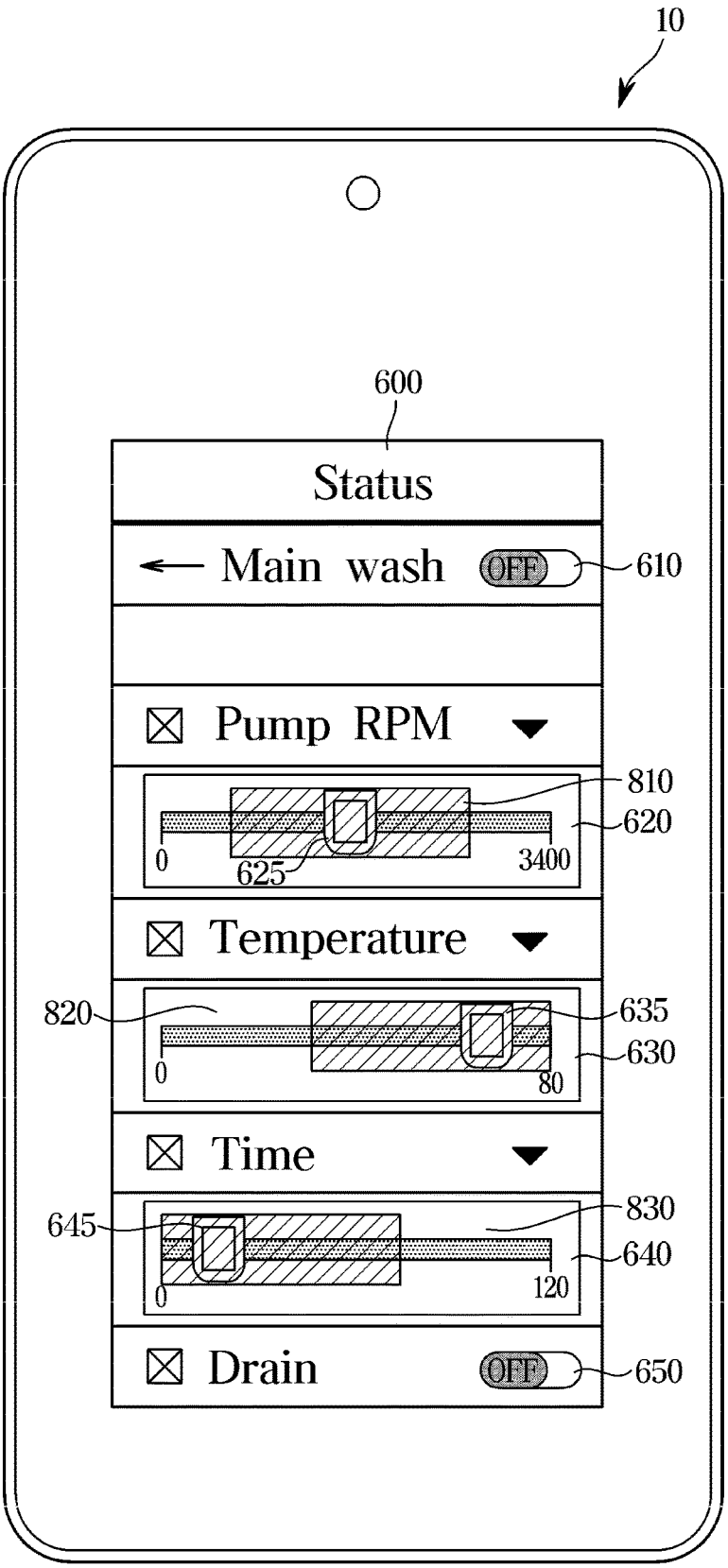
FIG. 8 illustrates a terminal device displaying recommended setting ranges of variable operating conditions, according to an embodiment.
Figure 9:
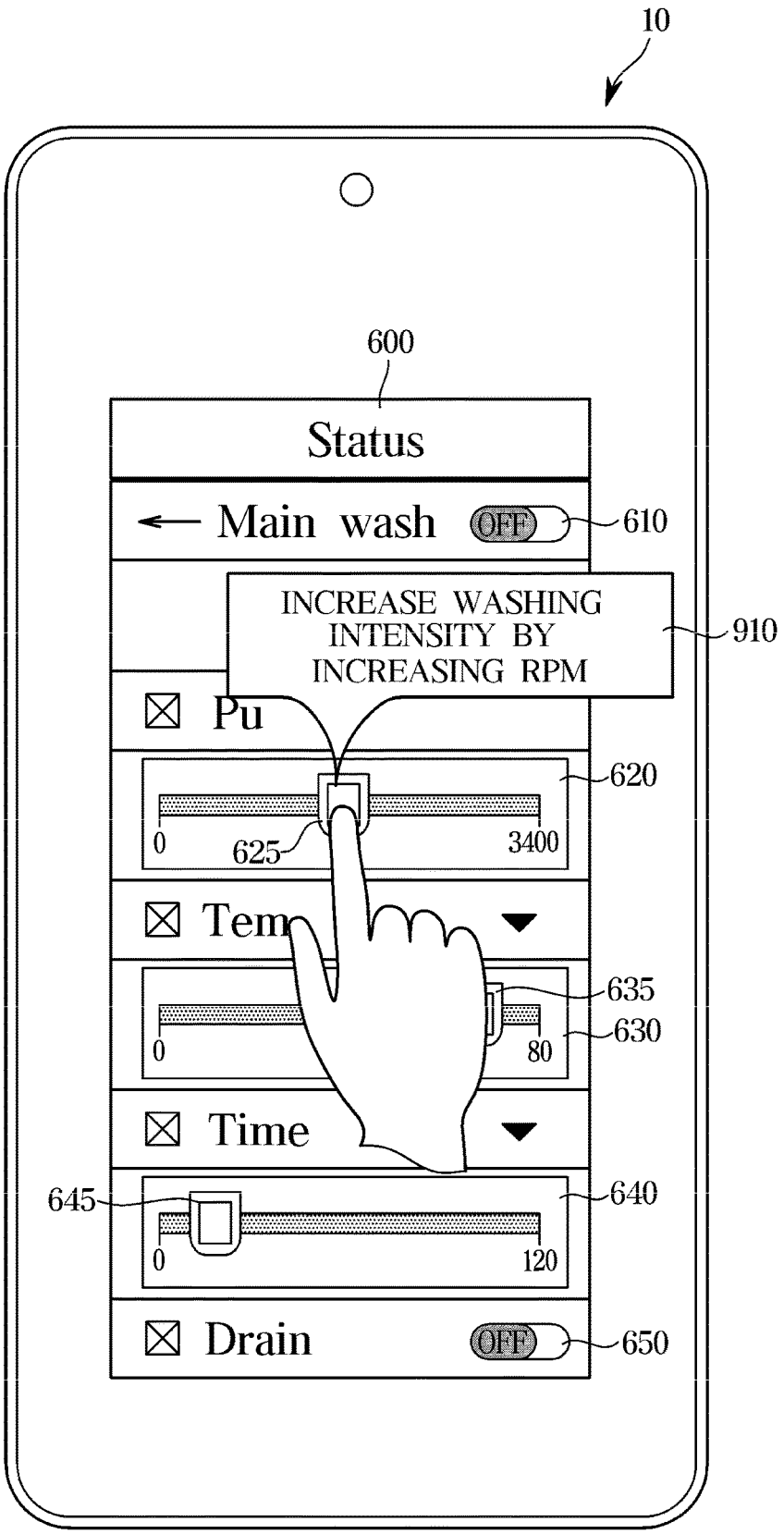
FIG. 9 illustrates a terminal device displaying effects of changing variable operating conditions, according to an embodiment.

FIG. 8 illustrates the terminal device 10 displaying recommended setting ranges of variable operating conditions, according to an embodiment. FIG. 9 illustrates the terminal device 10 displaying effects of changing variable operating conditions, according to an embodiment.

Referring to FIGS. 8 and 9, the terminal device 10 may display guide information for changing operating conditions to guide the user's changing of the operating conditions.

In an embodiment, the controller 130 may control the display 140 to display a recommended setting range (stage) of an operating condition as the guide information for changing the operating condition. In this case, the terminal device 10 may display the recommended setting range or recommended setting stage of each of the plurality of operating conditions included in each process. For example, as shown in FIG. 8, the terminal device 10 may display a recommended setting range 810 of the rpm of the pump 261 or 262 for the main washing process, a recommended setting range 820 of target temperature for the main washing process, and a recommended setting range 830 of the operation time for the main washing process. The user may change the operating condition to have a value within the recommended setting range, and thus determine a user-set course as a washing course with high washing efficiency that serves the purpose of use of the user.

In this case, information about the recommended setting range (stage) of each operating condition in each of the plurality of processes may be preset and stored in the storage 150.

In an embodiment, the controller 130 may control the display 140 to display an effect of changing an operating condition as guide information for changing the operating condition. In this case, the terminal device 10 may display an effect of changing each of the plurality of operating conditions included in each process. For example, the terminal device 10 may display information 910 about an effect of changing the rpm of the pump 261 when receiving a user input about the rpm of the pump 261, as shown in FIG. 9. Although only the information 910 about the effect of changing the rpm of the pump 261 is displayed in FIG. 9, the terminal device 10 may display effects of changing the plurality of operating conditions at the same time in some embodiments.

The user may grasp a washing effect according to changing of an operating condition and input a command to change the operating condition to serve the washing effect intended, and through this, may determine a user-set course as a washing course that fits for the purpose of use of the user.

As such, the terminal device 10 may determine a user-set course as a washing course with high washing efficiency that fits for the purpose of use of the user by displaying the guide information for changing the operating condition to guide the user's change of the operating condition.

Figure 11:
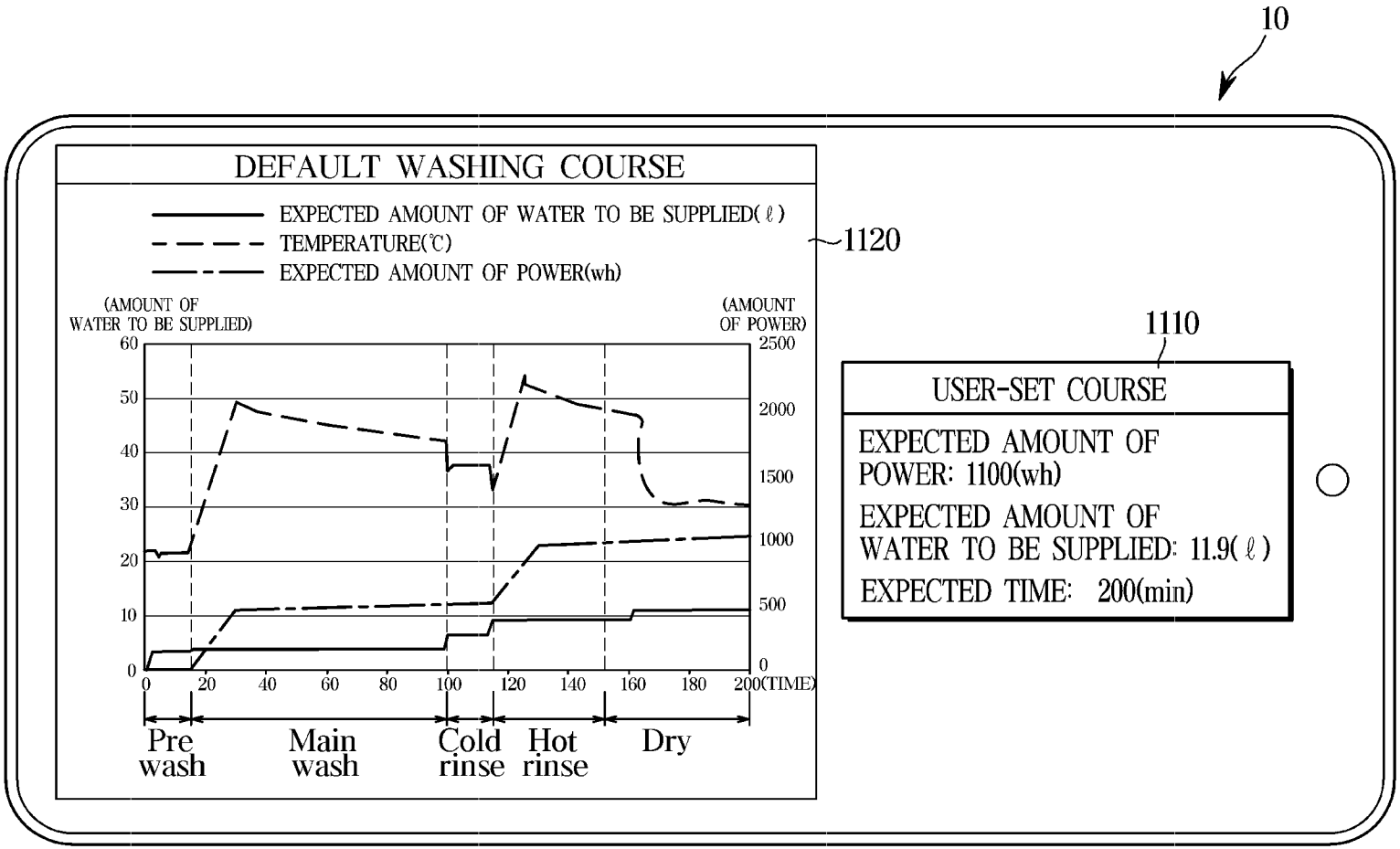
FIG. 11 illustrates a terminal device displaying an expected amount of power, an expected amount of water to be supplied, and an expected time for a user-set course, according to an embodiment.

FIG. 10 is a diagram for describing an occasion when the terminal device 10 changes a default washing course in response to a user input, according to an embodiment, and FIG. 11 illustrates the terminal device 10 displaying an expected amount of power, an expected amount of water to be supplied, and an expected time of a user-set course, according to an embodiment.

Referring to FIG. 10, in an embodiment, the controller 130 may determine a user-set course by changing an operating condition of the default washing course based on a command to change the operating condition input from the user.

Specifically, the controller 130 may determine a user-set course by changing an operating condition of at least one of a plurality of processes included in the default washing course based on a command to change the operating condition.

In other words, the user may create a user-set course by inputting a command to change an operating condition of at least one of the plurality of processes of the default washing course based on a user interface provided by the terminal device 10.

For example, as shown in FIG. 10, the terminal device 10 may receive a command to change whether to perform each of a pre-washing process, a first cold rinsing process, a second cold rinsing process, and a drying process. Furthermore, the terminal device 10 may receive commands to change rpm of the circulation pump 261, an operation time of the circulation pump 261, and a target temperature in the washing tub 23 for each of the washing process (pre-washing process or main washing process) and the rinsing process (cold rinsing process or hot rinsing process). In addition, the terminal device 10 may receive a command to change whether to perform draining for the pre-washing process and the cold rinsing process.

The terminal device 10 may create information about a user-set course by changing information about the default washing course as shown in FIG. 10 based on the command for changing.

In this case, the information about the washing course may include information about an amount of water to be supplied, rpm of the pump 261 or 262, target temperature and an operation time for each process, as shown in FIG. 10, and the operation time for the washing process and rinsing process may include a draining time, an operation time of the circulation pump 261 and an operation time of the drain pump 262, and the operation time for the drying process may include an operation time of the dryer 266.

Furthermore, in an embodiment, the controller 130 may determine an expected amount of power, an expected amount of water to be supplied, and an expected time of a user-set course based on information about the use-set course, and control the display 140 to display the determined expected amount of power, expected amount of water to be supplied, and expected time.

For example, the controller 130 may control the display 140 to display the changed expected amount of power, expected amount of water to be supplied, and expected time when the command to change the operating condition of the default washing course is input. In other words, the controller 130 may control the display 140 to display the expected amount of power, expected amount of water to be supplied, and expected time changed when the default washing course is changed to the user-set course.

For example, the terminal device 10 may display the expected amount of power, expected amount of water to be supplied, and expected time for the user-set course with information 1110 having the form of numerical values, as shown in FIG. 11. Furthermore, in an embodiment, the terminal device 10 may display the expected amount of power and expected amount of water to be supplied over expected time with information 1120 having the form of graphs. The form in which to display the expected information for the user-set course is not limited thereto, and any form that allows the expected information to be visually presented to the user may be equally applied without limitation.

With this, the user may receive information about the expected amount of power, expected amount of water to be supplied, and expected time for the user-set course based on the change command in real-time, and may perform or adjust the user-set course based on the received information. As such, the terminal device 10 may expand the range of the user's course selections by providing the expected information for the user-set course to the user.

Specifically, the terminal device 10 may provide course setup that serves the preference and purpose of the user by providing a user interface for changing operating conditions of each process of the default washing course, and may expand the range of the user's course selections by displaying the expected information for the user-set course before execution of the course.

It has been described that the terminal device 10 determines and displays expected information for the user-set course. Details of how the terminal device 10 determines the expected information for the user-set course will now be described.

Figure 13:
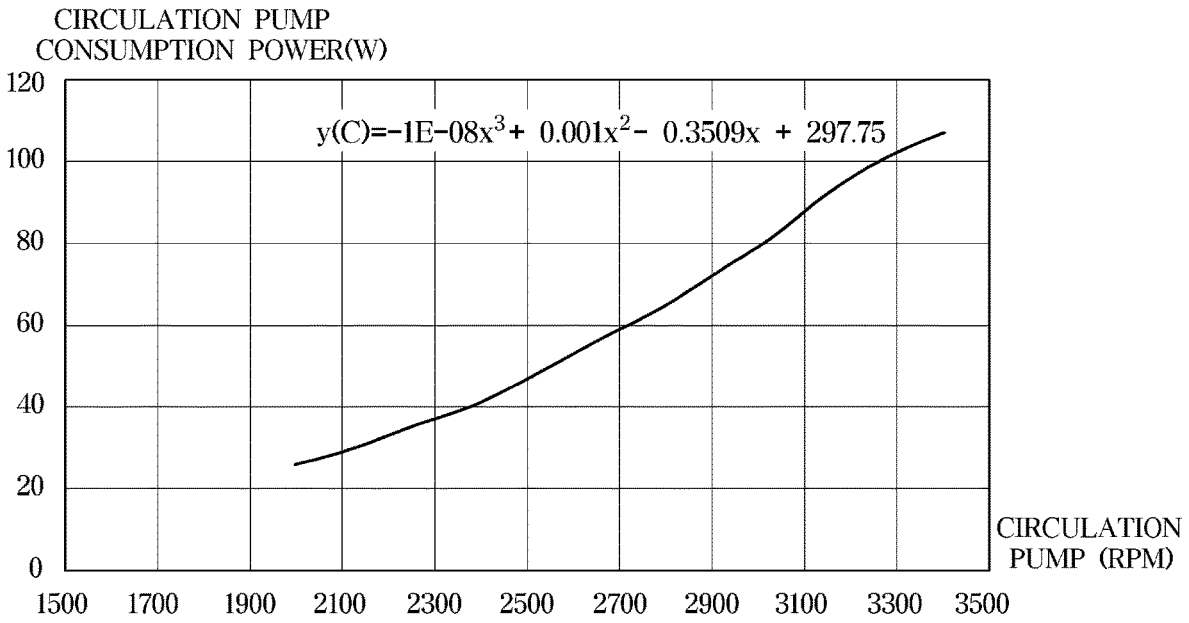
FIG. 13 is a diagram for describing an occasion when a terminal device determines an amount of power consumption of a circulation pump at each revolution per minute (rpm), according to an embodiment.
Figure 14:
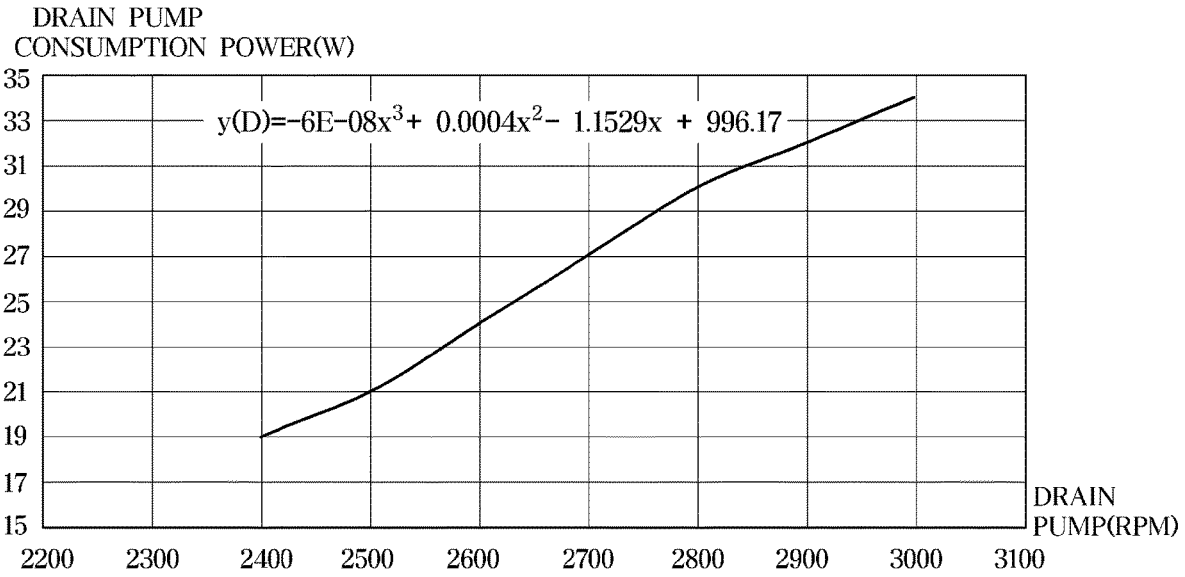
FIG. 14 is a diagram for describing an occasion when a terminal device determines an amount of power consumption of a drain pump at each rpm, according to an embodiment.

FIG. 12 is a diagram for describing an occasion when the terminal device 10 determines an amount of power consumption of the heater 263, according to an embodiment, FIG. 13 is a diagram for describing an occasion when the terminal device 10 determines an amount of power consumption of the circulation pump 261 at each rpm, according to an embodiment, FIG. 14 is a diagram for describing an occasion when the terminal device 10 determines an amount of power consumption of the drain pump 262 at each rpm, according to an embodiment, and FIG. 15 is a diagram for describing an occasion when the terminal device 10 determines an amount of power consumption of the electric component 260, according to an embodiment.

The controller 130 may predict an amount of power consumption (Wh) of each of the plurality of electric components 260 included in the dishwasher 20 for the user-set course, and determine a sum of amounts of power consumption of the plurality of electric components 260 to be the expected amount of power (Wh) for the user-set course.

In this case, the controller 130 may predict an amount of power consumption of the heater 263 based on target temperature and heating efficiency H of the dishwasher 20 for each of the plurality of processes included in the user-set course, and predict an amount of power consumption of each of the plurality of electric components 260 except for the heater 263 based on the operation time and consumption power for the user-set course.

The controller 130 may expect an amount of power consumption of the heater 263 based on the target temperature and the heating efficiency H of the dishwasher 20 for each of the plurality of processes included in the user-set course.

The heating efficiency H refers to an amount of power consumption (wh/□) required to raise the temperature in the washing tub 23 by 1□, corresponding to an amount of power consumption (wh/□) required to raise the temperature of all of the washing tub 23 of the dish washer 20, dishes in the washing tub 23*a* and water in the washing tub 23 by 1□.

The heating efficiency H may be set and stored in advance for each temperature section based on actual measurements, as shown in FIG. 12. Alternatively, the heating efficiency H may be set to one value such as an average of actual measurements of the respective temperature sections.

Specifically, the controller 130 may determine a difference in temperature between start temperature and target temperature for each process based on information about the user-set course, and multiply the heating efficiency H by the difference in temperature between the start temperature and the target temperature to determine an amount of power consumption (wh) of the heater 263 for each process. In this case, when the heating efficiency H is set differently for each temperature section, the amount of power consumption (wh) of the heater 263 for each process may be determined by reflecting the temperature sections.

Subsequently, the controller 130 may determine an amount of power consumption (wh) of the heater 263 for the user-set course by combining amounts of power consumption (wh) of the heater 263 for the respective processes.

As a result, the amount of power consumption of the heater 263, $wh_{Heater}$, for the user-set course may correspond to a value obtained by multiplying a difference in temperature Δtemp between the target temperature and the start temperature with heating efficiency H for each process and combining the multiplications for the respective processes as in equation 1.

$$wh_{heater} = \sum_{Start}^{End} (H * \Delta temp) \quad \text{[Equation 1]}$$

Furthermore, the controller 130 may predict an amount of power consumption of each of the plurality of electric components 260 except for the heater 263 based on an operation time and power consumption for the user-set course.

Specifically, the controller 130 may determine an operation time for each electric component 260 in each process based on the information about the user-set course, and determine an amount of power consumption (wh) of each of the electric components 260 for each process based on the operation time for the electric component 260 for the process and pre-stored consumption power (W) of each electric component 260.

The controller 130 may determine an amount of power consumption (wh) of all the electric components 260 for the process by combining amounts of power consumption (wh) for the respective electric components 260 in the process, and determine an amount of power consumption (wh) of the electric components 260 for the user-set course by combining amounts of power consumption (wh) of all the electric components 260 for each process.

In this case, the controller 130 may determine consumption power of the pump 261 or 262 based on the rpm of the pump 261 or 262, and predict an amount of power consumption of the pump 261 or 262 for the user-set course based on the determined consumption power and the operation time of the pump 261 or 262.

Specifically, the storage 150 may store a characteristic function y(C) for consumption power (W) depending on the rpm of the circulation pump 261, as shown in FIG. 13. In this case, the controller 130 may determine consumption power (W) of the circulation pump 261 for each process based on the characteristic function y(C) for consumption power (W) depending on the rpm of the circulation pump 261 and the rpm of the circulation pump 261 for each process of the user-set course. In this case, the characteristic function y(C) for the consumption power (W) depending on the rpm of the circulation pump 261 is a function built based on actual measurements, which may be a function of any order according to accuracy although shown herein as a cubic function as an example.

Furthermore, the storage 150 may store a characteristic function y(D) for consumption power (W) depending on the rpm of the drain pump 262, as shown in FIG. 14. In this case, the controller 130 may determine consumption power (W) of the drain pump 262 for each process based on the characteristic function y(D) of consumption power (W) depending on the rpm of the drain pump 262 and the rpm of the drain pump 262 for each process of the user-set course. In this case, the characteristic function y(D) for the consumption power (W) depending on the rpm of the drain pump 262 is a function built based on actual measurements, which may be a function of any order according to accuracy although shown herein as a cubic function as an example.

Moreover, the storage 150 may store information about the consumption power (W) of each of the plurality of electric components 260. For example, the storage 150 may store information about consumption power (W3), e.g., 5 W, for the water supply valve 265, consumption power (W4), e.g., 8 W, for the distributor 264, consumption power (W5), e.g., 5 W, for the dryer 266, etc., as shown in FIG. 15. Although consumption power of three of the electric components 260 is shown in FIG. 15, it is not limited thereto and information about consumption power of all the electric components 260 included in the dishwasher 20 may be stored.

As such, for a process, the controller 130 may determine an operation time for each of the electric components 260, determine consumption power of the circulation pump 261 based on the rpm and the characteristic function y(C) of the circulation pump 261 and consumption power of the drain pump 262 based on the rpm and the characteristic function y(D) of the drain pump 262, determine an amount of power consumption of the circulation pump 261 based on the consumption power of the circulation pump 261 and an operation time of the circulation pump 261, determine an amount of power consumption of the drain pump 262 based on the consumption power of the drain pump 262 and an operation time of the drain pump 262, determine an amount of power consumption of each of the electric components 264, 265 and 266 other than the pumps 261 and 262 based on consumption power W3, W4, W5 . . . , and an operation time of each of the electric components 264, 265 and 266 except for the pumps 261 and 262, and determine a total amount of power consumption of the plurality of electric components 260 for the process by combining amounts of power consumption of the respective electric components 260.

In other words, an amount of power consumption ($wh_{electronic}$) of the plurality of electric components 261, 262, 264, 265 and 266 except for the heater 263 for the user-set course may be determined to be a value obtained by calculating a sum of an amount of power consumption of the circulation pump 261 based on the characteristic function y(C) and operation time t1 (min) of the circulation pump 261, an amount of power consumption of the drain pump 262 based on the characteristic function y(D) and operation time t2 (min) of the drain pump 262, and amounts of power consumption of the electric components 264, 265 and 266 based on the respective consumption power W3, W4, W5, . . . , and operation times t3 (min), t4 (min), t5 (min), . . . , of the respective electric components 264, 265 and 266 for each process and combining the sums for the respective processes.

$$wh_{electronic} = \sum_{Start}^{End}\left(\frac{y(C)*t1)}{60} + \frac{y(D)*t2)}{60} + \frac{W3*t3}{60} + \frac{W4*t4}{60} + \frac{W5*t6}{60} + \ldots\right) \quad \text{[Equation 2]}$$

In conclusion, the controller 130 may predict an amount of power consumption of the heater 263 ($wh_{heater}$) based on target temperature and heating efficiency H of the dishwasher 20 for each of the plurality of processes included in the user-set course, and predict an amount of power consumption of the plurality of electric components 260 except for the heater 263 ($wh_{electronic}$) based on the operation time and consumption power for the user-set course.

In an embodiment, the controller 130 may determine a sum of amounts of power consumption of the plurality of electric components 260 by combining the amount of power consumption of the heater 263 ($wh_{heater}$) and the amount of power consumption of the electric components except for the heater 263 ($wh_{electronic}$), and determine a sum of amounts of power consumption of the plurality of electric components 260 as an expected amount of power for the user-set course ($Wh_{total}$). In other words, the expected amount of power consumption for the user-set course ($wh_{total}$) may be determined to be a sum of the amount of power consumption of the heater 263 ($wh_{heater}$) and the amount of power consumption of the electric components except for the heater 263 ($wh_{electronic}$).

$$wh_{total} = wh_{heater} + wh_{electronic} \quad \text{[Equation 3]}$$

Figure 16:
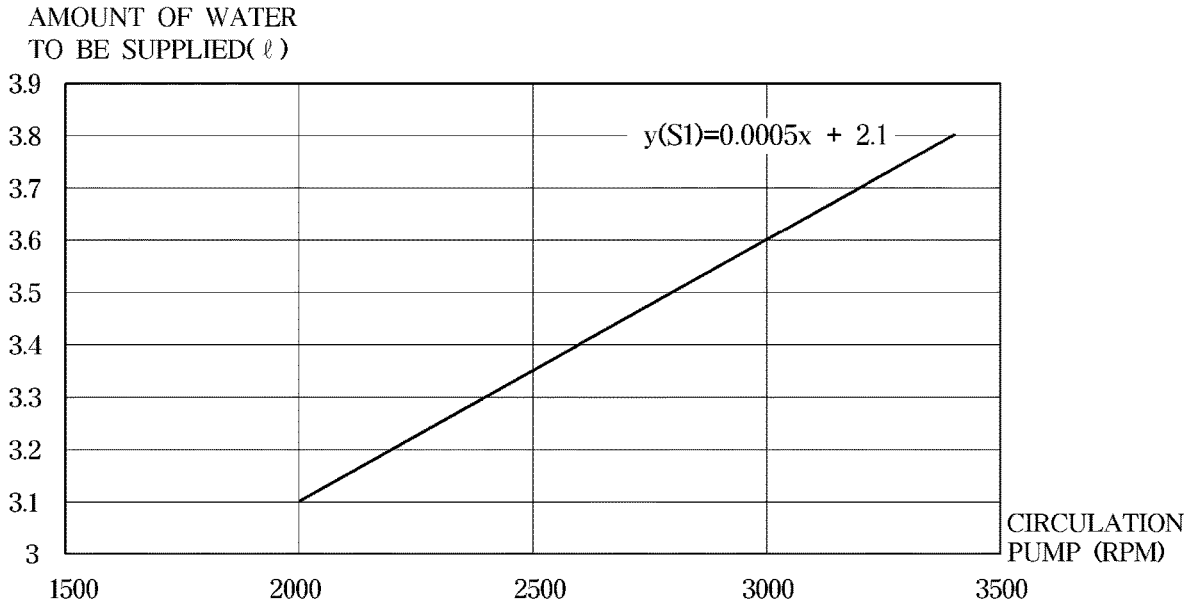
FIGS. 16 and 17 are diagrams for describing an occasion when a terminal device determines an expected amount of water to be supplied, according to an embodiment.
Figure 17:
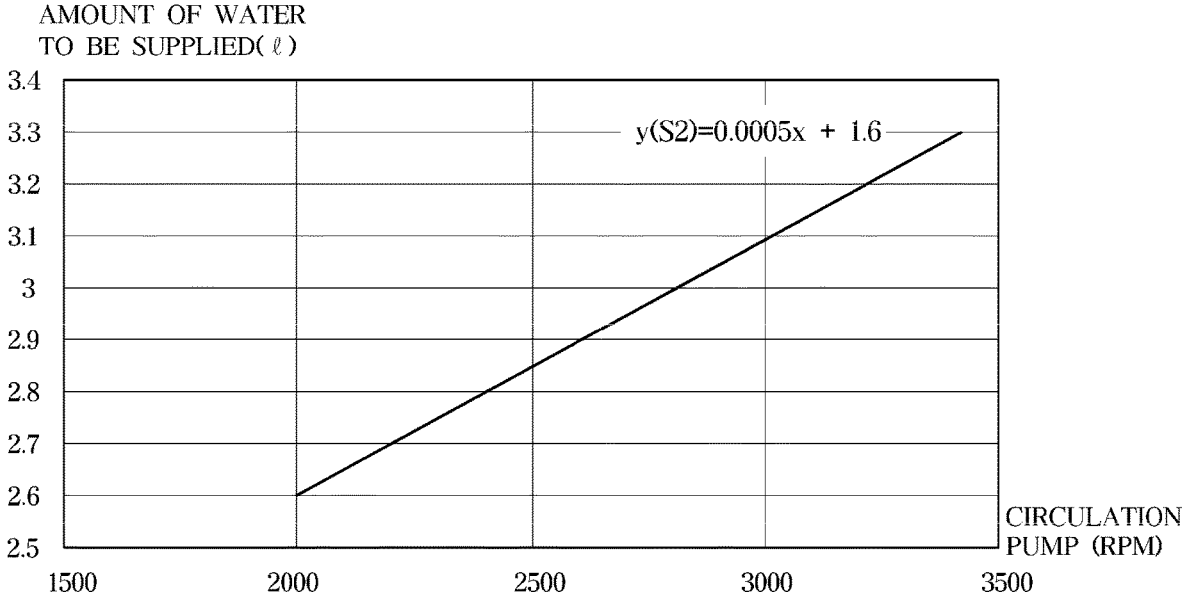

FIGS. 16 and 17 are diagrams for describing an occasion when the terminal device 10 determines an expected amount of water to be supplied, according to an embodiment.

Referring to FIGS. 16 and 17, in an embodiment, the controller 130 may determine an expected amount of water to be supplied based on the rpm of the circulation pump 261. Specifically, the controller 130 may determine an expected amount of water to be supplied for the user-set course based on the information about the amount of water to be supplied according to the rpm of the circulation pump 261 and the rpm of the circulation pump 261 set for the user-set course.

Specifically, in an embodiment, the storage 150 may store a characteristic function y(S) for an amount of water to be supplied depending on the rpm of the circulation pump 261, and the controller 130 may determine an expected amount of water to be supplied for the user-set course based on the characteristic function y(S) and rpm changed of the circulation pump 261.

In other words, the controller 130 may determine an amount of water to be supplied for each process based on the rpm of the circulation pump 261 and the characteristic function y(S) for the process, and determine a sum of amounts of water to be supplied for the respective processes as an expected amount of water to be supplied for the user-set course.

In this case, the characteristic function y(S) for the amount of water to be supplied depending on the rpm of the circulation pump 261 may be provided for each type of process or may be provided as one function for the whole course.

For example, the storage 150 may store a characteristic function y(S1) for a pre-washing process and a characteristic function y(S2) for processes (main washing and rinsing processes) except for the pre-washing process, separately. FIG. 16 shows the characteristic function y(S1) and FIG. 17 shows the characteristic function y(S2).

In this case, the controller 130 may determine an amount of water to be supplied for the pre-washing process based on the characteristic function y(S1) and the rpm of the circulation pump 261 for the pre-washing process, and determine an amount of water to be supplied for the processes except for the pre-washing process based on the characteristic function y(S2) and the rpm of the circulation pump 261 for the processes except for the pre-washing process. Subsequently, the controller 130 may determine the expected amount of water to be supplied for the user-set course by combining amounts of water to be supplied for the respective processes.

An embodiment of a method of controlling the terminal device 10 will now be described from a perspective. As for the method of controlling the terminal device 10, the terminal device 10 in the aforementioned embodiments may be used. Hence, what are described above with reference to FIGS. 1 to 17 may be equally applied in the following method of controlling the terminal device 10.

Figure 18:
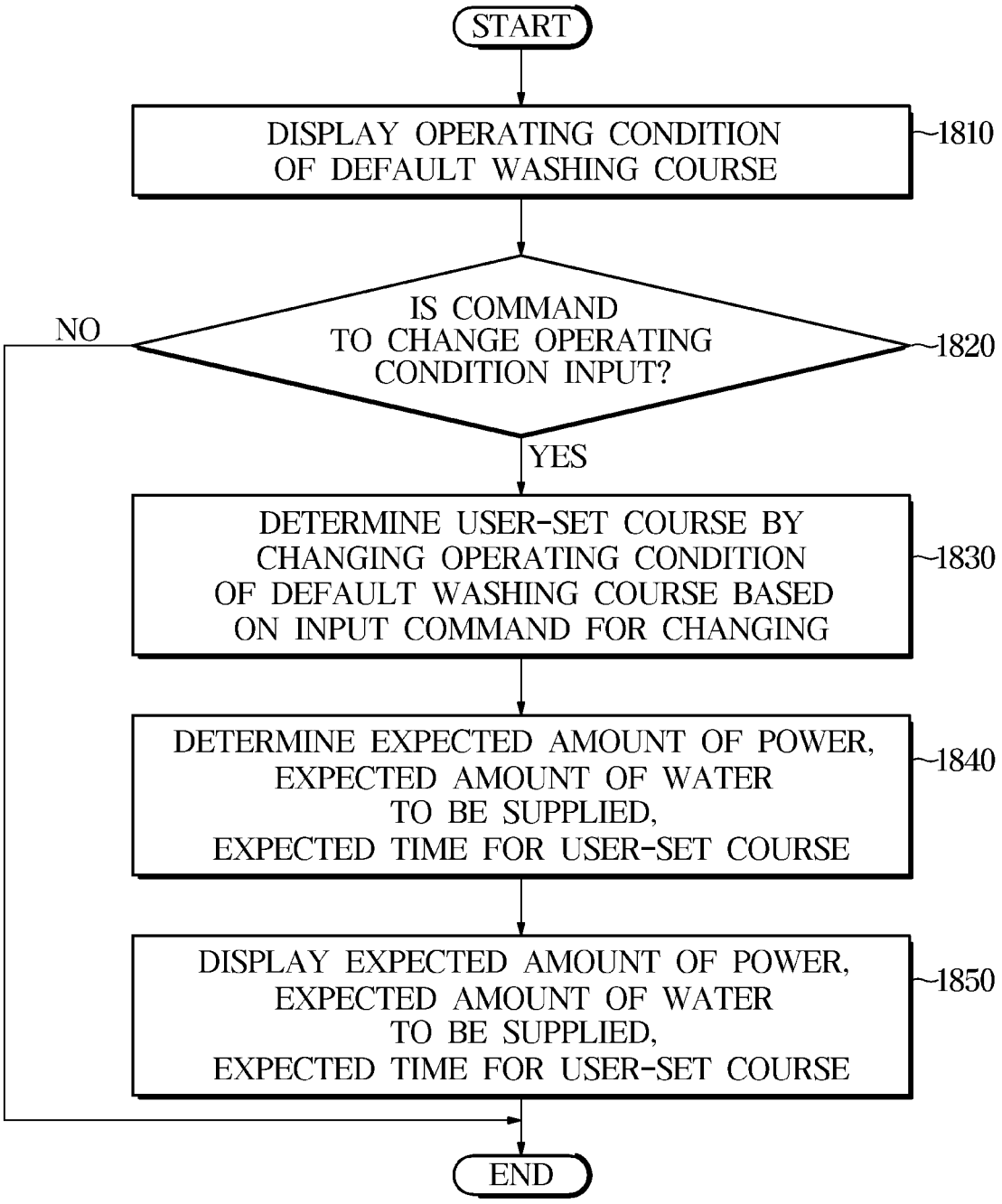
FIG. 18 is a flowchart of an occasion when a terminal device determines a user-set course based on a user input in a method of controlling the terminal device, according to an embodiment.

FIG. 18 is a flowchart of an occasion when the terminal device 10 determines a user-set course based on a user input in a method of controlling the terminal device 10, according to an embodiment.

Referring to FIG. 18, the terminal device 10 may display operating conditions of a default washing course, in 1810. In this case, the default washing course may be a type of washing course offered by the manufacturer, which may become a reference for changing. In other words, the user may determine a user-set course that fits for a purpose of use by changing an operating condition of the default washing course.

In an embodiment, when receiving a command to change an operating condition in 1820, the terminal device 10 may determine a user-set course by changing an operating condition of the default washing course based on the input command for the changing, in 1830.

In other words, the user may create a user-set course by changing an operating condition of each process of the default washing course.

For this, the controller 130 may control the display 140 to display a user interface by which to change an operating condition of each of the plurality of processes of the default washing course. Accordingly, the user may input a command to change the operating condition according to the user interface displayed on the display 140.

In an embodiment, the controller 130 may determine a user-set course by changing an operating condition of the default washing course based on a command to change the operating condition input from the user.

Specifically, the controller 130 may determine a user-set course by changing an operating condition of at least one of a plurality of processes included in the default washing course based on a command to change the operating condition.

In other words, the controller 130 may generate information about the user-set course by changing information about the default washing course stored in advance. In this case, the information about the washing course may include information about an amount of water to be supplied, rpm of the pump 261 or 262, target temperature and an operation time for each process, and the operation time for the washing process and rinsing process may include a drain time, an operation time of the circulation pump 261 and an operation time of the drain pump 262, and the operation time for the drying process may include an operation time of the dryer 266.

In an embodiment, the terminal device 10 may determine an expected amount of power, an expected amount of water to be supplied, and an expected time for the user-set course, in 1840.

In other words, in an embodiment, the controller 130 may determine the expected amount of power, the expected amount of water to be supplied, and the expected time for the user-set course based on the information about the user-set course.

In an embodiment, the terminal device 10 may display the expected amount of power, the expected amount of water to be supplied, and the expected time for the user-set course, in 1850.

For example, the controller 130 may control the display 140 to display the changed expected amount of power, expected amount of water to be supplied, and expected time when the command to change the operating condition of the default washing course is input. In other words, the controller 130 may control the display 140 to display the expected amount of power, expected amount of water to be supplied, and expected time changed when the default washing course is changed to the user-set course.

With this, the user may receive information about the expected amount of power, expected amount of water to be supplied, and expected time for the user-set course based on the change command in real-time, and may perform or adjust the user-set course based on the received information. As such, the terminal device 10 may expand the range of the user's course selections by providing the expected information for the user-set course to the user.

Specifically, the terminal device 10 may provide course setup that serves the preference and purpose of the user by providing a user interface for changing operating conditions of each process of the default washing course, and may expand the range of the user's course selections by displaying the expected information for the user-set course before execution of the course.

Figure 19:
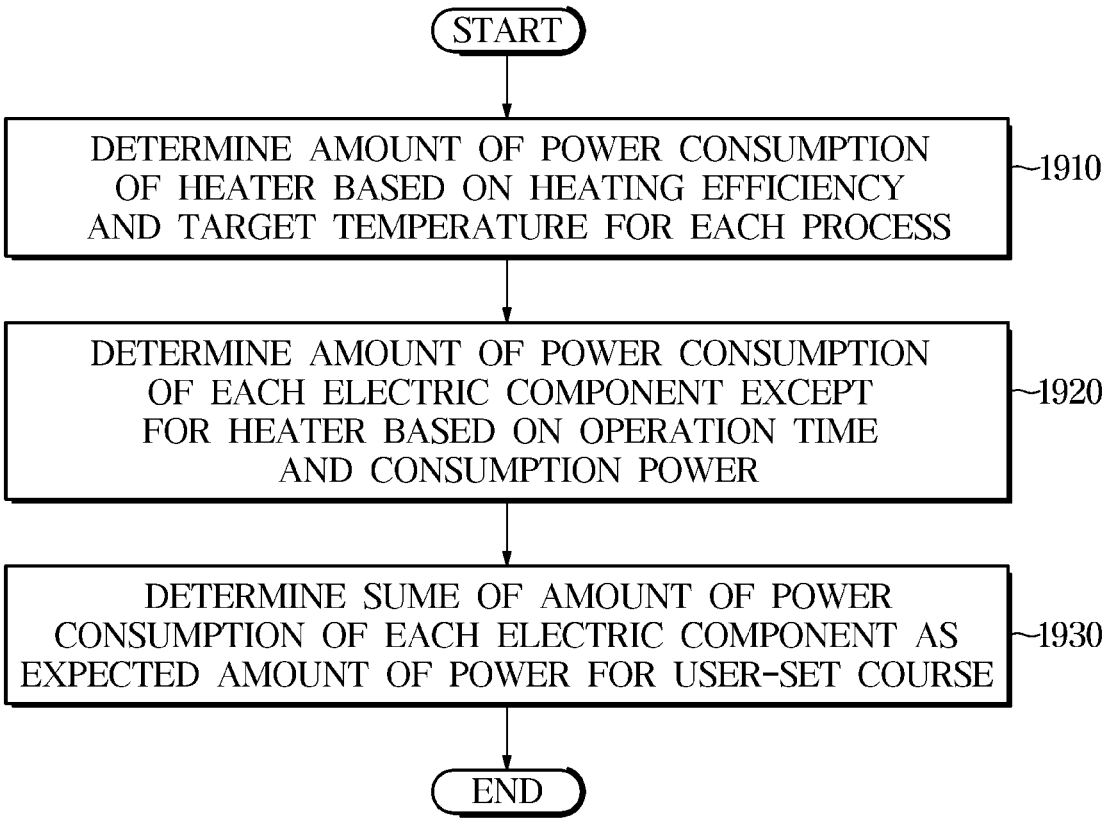
FIG. 19 is a flowchart of an occasion when a terminal device determines an expected amount of power in a method of controlling the terminal device, according to an embodiment.

FIG. 19 is a flowchart of an occasion when the terminal device 10 determines an expected amount of power in a method of controlling the terminal device 10, according to an embodiment.

Referring to FIG. 19, in an embodiment, the terminal device 10 may determine an amount of power consumption of the heater 231 based on heating efficiency and target temperature for each process, in 1910.

Specifically, the controller 130 may determine a difference in temperature between start temperature and target temperature of each process based on information about the user-set course, and multiply the heating efficiency H by the difference in temperature between the start temperature and the target temperature to determine an amount of power consumption (wh) of the heater 263 for each process. In this case, when the heating efficiency H is set differently for each temperature section, the amount of power consumption (wh) of the heater 263 for each process may be determined by reflecting the temperature sections.

Subsequently, the controller 130 may determine an amount of power consumption (wh) of the heater 263 for the user-set course by combining amounts of power consumption (wh) of the heater 263 for the respective processes.

In an embodiment, the terminal device 10 may determine an amount of power consumption of each of the plurality of electric components 260 except for the heater 263 based on the operation time and the consumption power.

For example, the controller 130 may predict an amount of power consumption of each of the plurality of electric components 260 except for the heater 263 based on the operation time and power consumption for the user-set course.

Specifically, the controller 130 may determine an operation time of each electric component 260 for each process based on the information about the user-set course, and determine an amount of power consumption (wh) of each of the electric components 260 for each process based on the operation time of each of the electric components 260 for the process and pre-stored consumption power (W) of each of the electric components 260.

The controller 130 may determine an amount of power consumption (wh) of all the electric components 260 for a process by combining amounts of power consumption (wh) for the respective electric components 260 in the process, and determine an amount of power consumption (wh) of the electric components 260 for the user-set course by combining amounts of power consumption (wh) of all the electric components 260 for the respective processes.

In this case, the controller 130 may determine consumption power of the pump 261 or 262 based on the rpm of the pump 261 or 262, and expect an amount of power consumption of the pump 261 or 262 for the user-set course based on the determined consumption power and the operation time of the pump 261 or 262.

In an embodiment, the terminal device 10 may determine an expected amount of power for the user-set course to be the sum of amounts of power consumption of the plurality of electric components 260, in 1930.

For example, the controller 130 may determine a sum of amounts of power consumption of the plurality of electric components 260 by combining the amount of power consumption of the heater 263 ($wh_{heater}$) and the amount of power consumption of the electric components except for the heater 263 ($wh_{electronic}$), and determine a sum of amounts of power consumption of the plurality of electric components 260 to be an expected amount of power for the user-set course ($Wh_{total}$).

Figure 20:
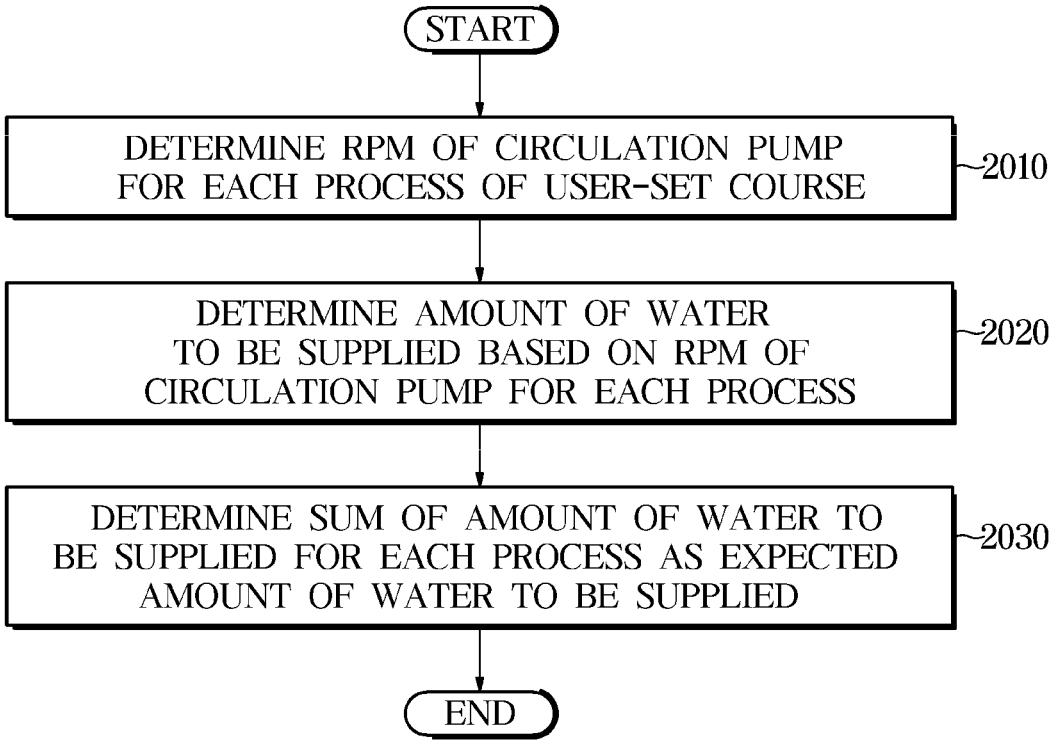
FIG. 20 is a flowchart of an occasion when a terminal device determines an expected amount of water to be supplied in a method of controlling the terminal device, according to an embodiment.

FIG. 20 is a flowchart of an occasion when the terminal device 10 determines an expected amount of water to be supplied in a method of controlling the terminal device 10, according to an embodiment.

Referring to FIG. 20, in an embodiment, the terminal device 10 may determine rpm of the circulation pump 261 for each process of the user-set course in 2010, determine an amount of water to be supplied for each process based on the rpm of the circulation pump for each process in 2020, and determine a sum of amounts of water to be supplied for the respective processes as the expected amount of water to be supplied in 2030.

In an embodiment, the controller 130 may determine an expected amount of water to be supplied based on the rpm of the circulation pump 261. Specifically, the controller 130 may determine an expected amount of water to be supplied for the user-set course based on the information about the amount of water to be supplied according to the rpm of the circulation pump 261 and the rpm of the circulation pump 261 set for the user-set course.

Specifically, in an embodiment, the storage 150 may store a characteristic function y(S) for an amount of water to be supplied depending on the rpm of the circulation pump 261, and the controller 130 may determine an expected amount of water to be supplied for the user-set course based on the characteristic function y(S) and rpm changed of the circulation pump 261.

In other words, the controller 130 may determine an amount of water to be supplied for each process based on the rpm of the circulation pump 261 and the characteristic function y(S) for the process, and determine a sum of amounts of water to be supplied for the respective processes as an expected amount of water to be supplied for the user-set course.

In this case, the characteristic function y(S) for the amount of water to be supplied depending on the rpm of the circulation pump 261 may be provided for each type of process or may be provided as one function for the whole course.

Meanwhile, the embodiments of the disclosure may be implemented in the form of a recording medium for storing instructions to be carried out by a computer. The instructions may be stored in the form of program codes, and when executed by a processor, may generate program modules to perform operation in the embodiments of the disclosure. The recording media may correspond to computer-readable recording media.

The computer-readable recording medium includes any type of recording medium having data stored thereon that may be thereafter read by a computer. For example, it may be a ROM, a RAM, a magnetic tape, a magnetic disk, a flash memory, an optical data storage device, etc.

The embodiments of the disclosure have thus far been described with reference to accompanying drawings. It will be obvious to those of ordinary skill in the art that the disclosure may be practiced in other forms than the embodiments as described above without changing the technical idea or essential features of the disclosure. The above embodiments are only by way of example, and should not be construed in a limited sense.

What is claimed is:

1. A terminal device comprising:

a display configured to display a plurality of operating conditions for each of a plurality of processes of a default washing course of a dishwasher;

an input configured to receive a command to change one or more operating conditions of the plurality of operating conditions for one or more processes of the plurality of processes of the default washing course from a user; and a controller configured to control the display to display at least one of an expected amount of power to be supplied, an expected amount of water to be supplied, and an expected time, which is changed according to a user-set course determined in response to the command received to change the one or more operating conditions for the one or more processes of the plurality of processes of the default washing course, wherein the plurality of processes include at least one of a pre-wash process, a main wash process, a rinse process, and a drying process, and the controller is further configured to:

obtain a user input to select at least one of the plurality of processes through the input, and generate the user-set course including at least one process selected based on the user input.

2. The terminal device of claim 1, wherein the controller is configured to determine the user-set course by changing the one or more operating conditions for the one or more processes of the plurality of processes of the default washing course based on the command received to change the one or more operating conditions.

3. The terminal device of claim 2, wherein the plurality of operating conditions for each of the plurality of processes of the default washing course includes:

at least one of revolutions per minute (rpm) of a pump, an operation time, a target temperature, whether to perform a process, or whether to perform draining.

4. The terminal device of claim 3, wherein the controller is configured to predict an amount of power consumption of each of a plurality of electric components included in the dishwasher to operate in the user-set course, and determine a sum of amounts of power consumption of the plurality of electric components to be the expected amount of power to be supplied according to the user-set course.

5. The terminal device of claim 4, wherein the controller is configured to predict an amount of power consumption of a heater based on heating efficiency of the dishwasher and a target temperature of each of the plurality of processes included in the user-set course, and predict an amount of power consumption of each of the plurality of electric components except for the heater based on an operation period and consumption power for the user-set course.

6. The terminal device of claim 5, wherein the controller is configured to determine consumption power of the pump according to the user-set course based on rpm of the pump.

7. The terminal device of claim 3, wherein the controller is configured to determine the expected amount of water to be supplied according to the user-set course based on rpm of the pump.

8. The terminal device of claim 2, wherein the controller is configured to control the display to display a user interface by which to change the one or more operating conditions of the one or more processes of the plurality of processes of the default washing course.

9. The terminal device of claim 8, wherein the controller is configured to control the display to display a recommended setting range of at least one of the plurality of operating conditions for each of the plurality of processes of the default washing course.

10. The terminal device of claim 8, wherein the controller is configured to control the display to display information about an effect of changing at least one of the plurality of operating conditions for each of the plurality of processes of the default washing course.

11. The terminal device of claim 2, further comprising:

a communication module configured to perform communication with the dishwasher, wherein the controller is configured to control the communication module to transmit information about the user-set course to the dishwasher.

* * * * *